US011027892B2

(12) United States Patent
Lyzenga et al.

(10) Patent No.: US 11,027,892 B2
(45) Date of Patent: Jun. 8, 2021

(54) PACKAGE INTEGRITY INDICATING CLOSURE

(71) Applicants: Deborah Lyzenga, Long Valley, NJ (US); Jeffrey Thomas Weber, Lake Zurich, IL (US); Scott William Huffer, Hartsville, SC (US); Benjamin Michael Davis, Columbia, SC (US)

(72) Inventors: Deborah Lyzenga, Long Valley, NJ (US); Jeffrey Thomas Weber, Lake Zurich, IL (US); Scott William Huffer, Hartsville, SC (US); Benjamin Michael Davis, Columbia, SC (US)

( * ) Notice: Subject to any disclaimer, the term of this patent is extended or adjusted under 35 U.S.C. 154(b) by 0 days.

(21) Appl. No.: 16/149,863

(22) Filed: Oct. 2, 2018

(65) Prior Publication Data

US 2019/0031402 A1 Jan. 31, 2019

Related U.S. Application Data

(60) Division of application No. 13/721,548, filed on Dec. 20, 2012, now Pat. No. 10,118,741, which is a (Continued)

(51) Int. Cl.
*B65D 43/00* (2006.01)
*B65D 43/02* (2006.01)
(Continued)

(52) U.S. Cl.
CPC ..... *B65D 43/0235* (2013.01); *B65D 75/5838* (2013.01); *B65D 77/206* (2013.01);
(Continued)

(58) Field of Classification Search
USPC ..... 383/5
See application file for complete search history.

(56) References Cited

U.S. PATENT DOCUMENTS 401,974 A * 4/1889 Smith et al. ..... B65D 25/04 220/524
811,092 A 1/1906 Roberts
(Continued)

FOREIGN PATENT DOCUMENTS

AU 768679 6/2001
AU 2002334419 B2 5/2003
(Continued)

OTHER PUBLICATIONS

'Cheese Range', Mintel gnpd, Jan. 26, 2001, Mintel Publishing, 1 page.
(Continued)

*Primary Examiner* — Peter N Helvey
(74) *Attorney, Agent, or Firm* — Fitch, Even, Tabin & Flannery LLP

(57) ABSTRACT

A resealable closure for a container in which package integrity is indicated by a structure which connects the closure to a remaining portion of the container which must be broken in order to gain access to the contents of the container for a first time. The package integrity feature, in one form, includes a structure associated with the closure, wherein upon opening the closure for a first time, the structure stretches, increasing a length of the structure until the structure eventually breaks, leaving one or both residual ends of the broken structure rippled or curved upward from the remainder of the container. In one alternative form, the structure is associated with a pull tab of the sealing panel, which comprises the closure, whereby either the structure must be broken first, prior to pulling back the sealing panel, or while pulling back the sealing panel for a first time, the structure breaks, prior to gaining access to the contents therein. Advantageously, the package integrity feature is integrally formed with the closure and a remaining portion
(Continued)

of the container. Integrity of the package is indicated by visually observing an intact breakable structure.

20 Claims, 29 Drawing Sheets

Related U.S. Application Data continuation of application No. 12/179,103, filed on Jul. 24, 2008, now abandoned.

(51) Int. Cl.
*B65D 75/58* (2006.01)
*B65D 77/20* (2006.01)

(52) U.S. Cl.
CPC ..... *B65D 77/2096* (2013.01); *B65D 2401/10* (2020.05); *B65D 2577/205* (2013.01); *B65D 2577/2033* (2013.01); *B65D 2577/2091* (2013.01)

(56) References Cited

U.S. PATENT DOCUMENTS 1,065,012 A * 6/1913 Wantanabe ..... B65D 27/30 229/81
1,106,721 A * 8/1914 Lewis ..... B65D 27/30 229/81
1,171,462 A * 2/1916 Rice ..... B65D 5/5405 229/120.24
1,791,352 A * 2/1931 Colonnese ..... B65D 27/30 229/79
1,915,503 A 6/1933 Schmidt
1,949,161 A * 2/1934 Haug ..... B65D 75/38 206/459.5
1,963,639 A * 6/1934 Ahlquist ..... B65D 27/30 229/80
1,978,035 A * 10/1934 Thom ..... B65B 61/182 206/830
2,033,550 A * 3/1936 Rosen ..... B65D 75/28 383/106
2,034,007 A * 3/1936 Smith ..... B65D 17/502 220/270
2,066,495 A * 1/1937 Swift ..... B65D 27/16 229/80
2,079,328 A * 5/1937 McBean ..... B65D 75/66 206/449
2,128,196 A * 8/1938 Vogel ..... B65D 27/30 229/80
2,248,578 A * 7/1941 Moore ..... B65D 33/16 206/260
2,260,064 A * 10/1941 Stokes ..... B65B 9/213 156/203
2,320,143 A * 5/1943 Johnson ..... B65D 75/68 206/800
2,321,042 A * 6/1943 Preis ..... B65D 5/727 229/121
2,330,015 A * 9/1943 Stokes ..... B65D 33/02 383/109
2,475,236 A * 7/1949 Gollub ..... B65D 33/20 383/84
2,554,160 A * 5/1951 Von Gunten ..... B65B 61/182 156/290
2,588,409 A * 3/1952 Olsen ..... B65D 75/54 206/495
2,605,897 A * 8/1952 Rundle ..... B65D 71/14 206/264
2,621,788 A * 12/1952 Hitchcock ..... B65D 83/0847 221/63
2,684,807 A * 7/1954 Gerrish ..... B65D 75/66 383/206
2,719,647 A * 10/1955 Freeman ..... B65D 17/502 220/271
2,823,795 A * 2/1958 Moore ..... B65D 33/02 383/106
2,965,224 A * 12/1960 Harwood ..... B65D 75/5827 206/494
3,080,238 A * 3/1963 Kraft ..... B65D 75/66 383/206
3,127,273 A * 3/1964 Monahan ..... B65B 9/06 53/442
3,179,326 A * 4/1965 Underwood ..... B65D 75/68 229/203
3,186,628 A * 6/1965 Rohde ..... B65D 75/5805 206/364
3,187,982 A * 6/1965 Underwood ..... B65D 75/68 229/205
3,217,871 A * 11/1965 Lee ..... B65D 75/30 206/440
3,235,165 A * 2/1966 Jackson ..... B65D 17/502 221/302
3,245,525 A * 4/1966 Shoemaker ..... B65D 75/38 206/249
3,259,303 A * 7/1966 Repko ..... B65D 75/5833 206/497
3,260,358 A * 7/1966 Gottily ..... B65D 75/002 206/410
3,272,422 A * 9/1966 Miller ..... B65D 77/2096 206/527
3,291,377 A * 12/1966 Eggen ..... B65D 65/02 206/459.5
3,298,505 A * 1/1967 Stephenson ..... B65D 77/2008 206/772
3,310,032 A * 3/1967 Adams ..... A01K 15/02 119/427
3,311,032 A 3/1967 Lucas
3,326,450 A * 6/1967 Langdon ..... B65D 75/20 156/291
3,331,501 A * 7/1967 Stewart, Jr. ..... B65D 75/02 206/386
3,343,541 A * 9/1967 Bellamy, Jr. ..... A61J 1/10 206/438
3,373,922 A * 3/1968 Watts ..... B65D 5/3642 229/103
3,373,926 A * 3/1968 Voigtman ..... B65B 9/2028 383/205
3,454,210 A * 7/1969 Spiegel ..... B65D 75/30 229/123.1
3,471,005 A * 10/1969 Sexstone ..... A24F 23/02 206/260
3,520,401 A * 7/1970 Granowitz ..... B65D 77/0413 206/229
3,528,825 A * 9/1970 Doughty ..... A22C 13/023 134/22.11
3,570,751 A * 3/1971 Trewella ..... B65D 75/5827 383/207
3,595,466 A * 7/1971 Rosenburg, Jr. ..... B65D 5/5435 229/208
3,595,468 A * 7/1971 Repko ..... B65D 33/22 206/0.84
3,618,751 A * 11/1971 Rich ..... B65D 75/326 206/219
3,630,346 A * 12/1971 Burnside ..... B65D 75/32 206/532
3,651,615 A * 3/1972 Bohner ..... B29C 65/08 53/452
3,653,502 A * 4/1972 Beaudoin ..... A61F 15/001 206/440
3,685,720 A * 8/1972 Brady ..... B65D 75/66 206/439
3,687,352 A * 8/1972 Kalajian ..... B65D 5/5475 229/123.2
3,740,238 A * 6/1973 Graham ..... B65D 1/36 426/124
3,757,078 A * 9/1973 Conti ..... B23K 15/0013 219/121.75
3,790,744 A * 2/1974 Bowen ..... B29C 59/007 219/121.69

(56) References Cited

U.S. PATENT DOCUMENTS 3,811,564 A * 5/1974 Braber ..... B65B 47/02 206/469
3,865,302 A * 2/1975 Kane ..... B65D 77/20 229/123.1
3,885,727 A * 5/1975 Gilley ..... B65D 1/34 229/407
3,905,646 A * 9/1975 Brackmann ..... B65D 5/4608 206/155
3,909,582 A * 9/1975 Bowen ..... B23K 26/0846 219/121.69
3,910,410 A * 10/1975 Shaw ..... B65D 75/26 220/359.3
3,938,659 A * 2/1976 Wardwell ..... B65D 75/5855 206/439
3,966,046 A * 6/1976 Deutschlander ... B65D 5/48048 206/445
3,971,506 A * 7/1976 Roenna ..... B65D 5/701 229/234
3,979,050 A * 9/1976 Cilia ..... B65D 33/002 383/35
4,082,216 A * 4/1978 Clarke ..... B65D 33/02 229/164.1
4,113,104 A * 9/1978 Meyers ..... B65D 5/5425 206/807
4,140,046 A * 2/1979 Marbach ..... B26F 3/06 493/203
4,143,695 A * 3/1979 Hoehn ..... A45C 11/20 220/215
4,156,493 A * 5/1979 Julius ..... B65D 83/0805 206/494
4,185,754 A * 1/1980 Julius ..... A47K 10/421 206/210
4,192,420 A * 3/1980 Worrell, Sr. ..... B65D 81/22 206/205
4,192,448 A * 3/1980 Porth ..... B65D 27/14 229/80
4,197,949 A * 4/1980 Carlsson ..... B65D 5/065 229/123.3
4,210,246 A * 7/1980 Kuchenbecker ..... B65D 75/366 206/461
4,258,876 A * 3/1981 Ljungcrantz ..... B65D 5/708 220/255.1
4,260,061 A * 4/1981 Jacobs ..... B65D 75/5833 383/203
4,273,815 A * 6/1981 Gifford ..... B32B 27/00 383/99
4,285,681 A * 8/1981 Walitalo ..... B29C 65/745 156/250
4,306,367 A * 12/1981 Otto ..... B65D 5/4229 206/831
4,337,862 A * 7/1982 Suter ..... B65D 75/44 383/211
4,364,478 A * 12/1982 Tuns ..... B65D 75/68 383/205
4,397,415 A * 8/1983 Lisiecki ..... B65D 5/541 229/223
4,411,365 A * 10/1983 Horikawa ..... B65D 5/5435 229/117.31
4,420,080 A * 12/1983 Nakamura ..... B65B 61/184 206/449
4,428,477 A * 1/1984 Cristofolo ..... B65D 75/5827 206/210
4,460,088 A * 7/1984 Rugenstein ..... B65D 75/5838 206/264
4,464,154 A 8/1984 Ljungcrantz
4,488,647 A * 12/1984 Davis ..... B32B 27/08 206/525
4,506,488 A * 3/1985 Matt ..... B65B 57/00 53/450
4,518,087 A * 5/1985 Goglio ..... B29C 65/18 383/210
4,538,396 A * 9/1985 Nakamura ..... B65D 75/5827 53/412
4,545,844 A * 10/1985 Buchanan ..... B29C 65/74 156/251
4,548,824 A * 10/1985 Mitchell ..... B65D 21/08 206/497
4,548,852 A * 10/1985 Mitchell ..... B65D 21/08 206/497
4,549,063 A * 10/1985 Ang ..... B23K 26/0846 219/121.69
4,550,831 A * 11/1985 Whitford ..... A61L 2/26 206/439
4,552,269 A * 11/1985 Chang ..... B65D 75/5838 229/125.09
4,557,505 A * 12/1985 Schaefer ..... B44F 1/00 206/807
4,570,820 A * 2/1986 Murphy ..... B65D 33/24 206/210
4,572,377 A * 2/1986 Beckett ..... B65D 75/5844 383/204
4,589,943 A 5/1986 Kimball
4,608,288 A * 8/1986 Spindler ..... G09F 3/0292 283/108
4,610,357 A * 9/1986 Nakamura ..... B65B 9/073 206/449
4,613,046 A * 9/1986 Kuchenbecker ..... B65D 5/541 229/208
4,616,470 A * 10/1986 Nakamura ..... B65B 61/184 53/412
4,625,495 A * 12/1986 Holovach ..... B29C 65/10 53/450
4,632,299 A 12/1986 Holmberg
4,638,911 A * 1/1987 Prohaska ..... B65D 75/66 206/484
4,648,509 A * 3/1987 Alves ..... B65D 75/38 206/802
4,651,874 A 3/1987 Nakamura
4,653,250 A 3/1987 Nakamura
4,658,963 A * 4/1987 Jud ..... B65D 75/585 229/87.05
4,667,453 A * 5/1987 Goglio ..... B29C 65/18 426/123
4,671,453 A * 6/1987 Cassidy ..... B65D 65/24 206/147
4,673,085 A * 6/1987 Badouard ..... B65D 77/2032 206/461
4,679,693 A * 7/1987 Forman ..... B65D 75/5838 383/203
4,694,960 A * 9/1987 Phipps ..... B65D 75/366 206/469
4,696,404 A * 9/1987 Corella ..... B65D 75/5816 383/200
4,709,399 A * 11/1987 Sanders ..... B65D 33/1691 206/813
4,723,301 A * 2/1988 Chang ..... B65D 75/5838 383/211
4,738,365 A * 4/1988 Prater ..... B65D 5/302 229/123.3
4,739,879 A 4/1988 Nakamura
4,770,325 A * 9/1988 Gordon ..... B65D 5/708 222/481
4,784,885 A * 11/1988 Carespodi ..... B32B 7/06 428/36.8
4,786,355 A 11/1988 Kontz
4,790,436 A * 12/1988 Nakamura ..... B65D 83/0805 206/449
4,798,295 A * 1/1989 Rausing ..... B65D 5/708 229/229
4,798,296 A * 1/1989 Lagerstedt ..... B65D 5/065 220/270
4,799,594 A * 1/1989 Blackman ..... B65D 5/701 229/125
4,811,848 A * 3/1989 Jud ..... B65D 75/5838 383/205
4,818,120 A * 4/1989 Addiego ..... B65D 33/30 383/5

(56) References Cited

U.S. PATENT DOCUMENTS 4,838,429 A * 6/1989 Fabisiewicz ..... B65D 75/5838 383/205
4,840,270 A * 6/1989 Caputo ..... B29C 59/10 206/205
4,845,470 A * 7/1989 Boldt, Jr. ..... B65D 5/4291 340/540
4,848,575 A * 7/1989 Nakamura ..... B65D 83/0805 206/449
4,858,780 A * 8/1989 Odaka ..... B65D 77/2044 220/269
4,863,064 A * 9/1989 Dailey, III ..... B65D 75/54 221/48
4,865,198 A * 9/1989 Butler ..... B41M 3/14 206/459.1
4,866,911 A * 9/1989 Grindrod ..... B65B 11/50 53/432
4,874,096 A * 10/1989 Tessera-Chiesa ..... B65D 75/5838 383/5
4,876,123 A * 10/1989 Rivera ..... B65D 55/026 428/34.2
4,889,731 A * 12/1989 Williams, Jr. ..... B32B 7/06 426/106
4,901,505 A * 2/1990 Williams, Jr. ..... B32B 7/06 426/123
4,902,142 A * 2/1990 Lammert ..... B65D 33/20 383/205
4,917,247 A * 4/1990 Jud ..... B65D 75/5833 229/87.05
4,943,439 A * 7/1990 Andreas ..... B65D 81/3453 426/107
4,972,953 A * 11/1990 Friedman ..... B65D 55/026 206/459.1
4,998,666 A * 3/1991 Ewan ..... B65D 33/34 206/459.1
4,999,081 A * 3/1991 Buchanan ..... B29C 65/18 156/251
5,000,320 A * 3/1991 Kuchenbecker ..... B65D 5/705 229/122
5,001,325 A * 3/1991 Huizinga ..... B23K 26/0846 219/121.69
5,005,264 A * 4/1991 Breen ..... B65D 33/1691 24/30.5 R
5,010,231 A * 4/1991 Huizinga ..... B29C 59/007 219/121.69
5,018,625 A * 5/1991 Focke ..... B65D 75/5838 206/494
5,029,712 A * 7/1991 O'Brien ..... B65D 75/5838 229/123.3
5,040,685 A * 8/1991 Focke ..... B65D 75/5838 206/494
5,046,621 A * 9/1991 Bell ..... B65D 27/14 383/113
5,048,718 A * 9/1991 Nakamura ..... B65B 9/073 206/233
5,054,619 A * 10/1991 Muckenfuhs ..... A61F 15/001 206/494
5,060,848 A * 10/1991 Ewan ..... B65D 33/34 206/459.1
5,065,868 A * 11/1991 Cornelissen ..... B65D 33/02 206/494
5,076,439 A * 12/1991 Kuchenbecker ..... B65D 5/06 229/132
5,077,064 A * 12/1991 Hustad ..... B65D 33/2533 383/5
5,078,509 A * 1/1992 Center ..... B65D 33/18 383/107
5,082,702 A * 1/1992 Alband ..... B65D 55/026 428/36.92
5,085,724 A * 2/1992 Focke ..... B65B 61/18 156/256
5,096,113 A 3/1992 Focke
5,100,003 A 3/1992 Jud
5,103,980 A * 4/1992 Kuchenbecker ..... B65D 5/5435 229/120
5,108,669 A * 4/1992 van Dijk ..... B65D 33/01 264/400
5,124,388 A * 6/1992 Pruett ..... B65D 65/38 428/458
5,125,211 A * 6/1992 O'Brien ..... B65D 75/5838 53/133.4
5,134,001 A * 7/1992 Osgood ..... B32B 27/08 428/35.2
5,158,499 A * 10/1992 Guckenberger ..... B23K 26/067 206/524.2
5,161,350 A * 11/1992 Nakamura ..... B65B 9/067 53/133.4
5,167,455 A * 12/1992 Forman ..... B65D 33/34 383/211
5,167,974 A * 12/1992 Grindrod ..... B65B 11/50 156/152
5,174,659 A * 12/1992 Laske ..... B65D 33/20 383/207
5,184,771 A * 2/1993 Jud ..... B65D 75/5844 206/524.2
5,190,152 A * 3/1993 Smith ..... B42F 15/0094 206/425
5,197,618 A * 3/1993 Goth ..... B65D 51/20 206/484.2
5,222,422 A * 6/1993 Benner, Jr. ..... B26D 7/01 83/152
5,222,813 A * 6/1993 Kopp ..... B65D 75/5805 229/87.05
5,229,180 A * 7/1993 Littmann ..... B65D 75/5827 219/121.68
5,294,470 A * 3/1994 Ewan ..... B65D 33/34 229/102
5,307,988 A * 5/1994 Focke ..... B65D 75/08 206/494
5,310,262 A * 5/1994 Robison ..... B65D 75/5894 383/113
5,333,735 A * 8/1994 Focke ..... B65D 75/5838 206/494
5,344,007 A * 9/1994 Nakamura ..... B65D 81/22 206/205
5,352,466 A * 10/1994 Delonis ..... B65D 75/58 383/210
5,356,068 A * 10/1994 Moreno ..... B65D 75/5833 229/87.05
5,366,087 A * 11/1994 Bane ..... B65D 33/1691 206/459.5
5,371,997 A 12/1994 Kopp
5,374,179 A * 12/1994 Swanson ..... B29C 33/02 156/251
5,375,698 A * 12/1994 Ewart ..... A45C 11/005 206/205
5,381,643 A * 1/1995 Kazaitis ..... A22C 13/023 53/415
5,382,190 A * 1/1995 Graves ..... A22C 13/023 206/443
5,388,757 A * 2/1995 Lorenzen ..... B65D 51/185 229/123.2
5,405,629 A * 4/1995 Marnocha ..... B65D 33/2533 206/466
5,407,070 A * 4/1995 Bascos ..... A61M 5/002 206/364
5,409,115 A * 4/1995 Barkhorn ..... B65D 75/5833 206/440
5,409,116 A * 4/1995 Aronsen ..... B65B 5/022 206/484
5,439,102 A * 8/1995 Brown ..... A61B 17/06133 206/227
5,454,207 A * 10/1995 Storandt ..... A45D 40/26 53/210
5,460,838 A * 10/1995 Wermund ..... B65D 75/58 383/35
5,460,844 A * 10/1995 Gaylor ..... B65B 29/028 426/394

(56) References Cited

U.S. PATENT DOCUMENTS 5,461,845 A * 10/1995 Yeager ..... B65B 61/188 383/203
5,464,092 A * 11/1995 Seeley ..... B65D 5/4291 206/217
5,470,015 A * 11/1995 Jud ..... B65D 75/5844 229/87.05
5,489,060 A * 2/1996 Godard ..... B65D 75/68 229/125.37
5,499,757 A * 3/1996 Back ..... B65D 27/30 229/313
5,503,858 A * 4/1996 Reskow ..... B65D 1/36 206/557
5,505,305 A * 4/1996 Scholz ..... A61F 13/041 206/438
5,515,965 A * 5/1996 Boldrini ..... B65D 77/32 206/264
5,519,982 A * 5/1996 Herber ..... B65B 9/093 53/133.3
5,520,939 A * 5/1996 Wells ..... B65D 43/0254 206/471
5,524,759 A * 6/1996 Herzberg ..... B65D 75/5838 206/494
5,531,325 A * 7/1996 Deflander ..... A47K 10/20 206/494
5,538,129 A * 7/1996 Chester ..... A61C 19/02 206/469
5,550,346 A * 8/1996 Andriash ..... B23K 26/08 219/121.72
5,558,438 A * 9/1996 Warr ..... B65D 33/08 383/10
5,582,342 A * 12/1996 Jud ..... B65D 75/5838 229/87.05
5,582,853 A 12/1996 Marnocha
5,582,887 A * 12/1996 Etheredge ..... G09F 3/0292 206/807
5,591,468 A * 1/1997 Stockley, III ..... B65B 7/168 206/439
5,630,308 A 5/1997 Guckenberger
5,633,058 A * 5/1997 Hoffer ..... B65D 5/0236 156/190
5,636,732 A * 6/1997 Gilels ..... B65D 43/169 206/37
5,637,369 A * 6/1997 Stewart ..... G09F 3/0288 283/81
5,647,100 A * 7/1997 Porchia ..... B65D 33/2508 24/30.5 R
5,647,506 A * 7/1997 Julius ..... A47K 10/421 206/449
5,664,677 A * 9/1997 O'Connor ..... B65D 75/5838 206/494
5,672,224 A 9/1997 Kaufmann
5,688,394 A * 11/1997 McBride, Jr. ..... B65D 83/0805 134/40
5,688,463 A * 11/1997 Robichaud ..... B23K 26/0838 219/121.69
5,702,743 A 12/1997 Wells
5,709,479 A * 1/1998 Bell ..... B65D 75/008 383/10
5,725,311 A * 3/1998 Ponsi ..... B65D 75/5838 206/494
D394,204 S * 5/1998 Seddon ..... D9/421
D394,605 S * 5/1998 Skiba ..... D9/709
5,749,657 A * 5/1998 May ..... B65D 33/14 383/17
5,770,283 A * 6/1998 Gosselin ..... G09F 3/0292 206/807
5,791,465 A * 8/1998 Niki ..... B65D 75/5894 206/210
5,795,604 A * 8/1998 Wells ..... B65D 43/021 206/471
5,819,931 A * 10/1998 Boucher ..... B65D 73/0035 206/349
5,820,953 A * 10/1998 Beer ..... B29C 59/007 428/35.7
5,826,101 A * 10/1998 Beck ..... G06F 13/28 712/34
5,833,368 A * 11/1998 Kaufman ..... B65D 75/5838 383/205
5,855,435 A * 1/1999 Chiesa ..... B65D 75/5838 383/204
5,862,101 A * 1/1999 Haas ..... G04F 1/00 116/200
5,873,483 A * 2/1999 Gortz ..... B65D 77/2056 220/269
5,873,607 A * 2/1999 Waggoner ..... G09F 3/0289 283/101
5,882,116 A * 3/1999 Backus ..... B65D 27/30 206/807
5,885,673 A * 3/1999 Light ..... B32B 27/08 428/35.4
5,906,278 A * 5/1999 Ponsi ..... B65D 75/5838 206/210
5,908,246 A * 6/1999 Arimura ..... B65D 75/5838 229/123.2
5,928,749 A * 7/1999 Forman ..... B65D 33/1691 229/87.01
5,938,013 A * 8/1999 Palumbo ..... B65D 75/008 206/210
5,939,156 A * 8/1999 Rossi ..... B65D 75/66 206/443
5,945,145 A * 8/1999 Narsutis ..... B65D 75/5838 383/203
5,956,794 A * 9/1999 Skiba ..... A47K 7/03 15/104.93
5,993,962 A * 11/1999 Timm ..... B65D 33/20 428/349
5,996,797 A * 12/1999 Flaig ..... B65D 77/02 206/210
5,997,177 A * 12/1999 Kaufman ..... B65D 75/5827 383/202
6,006,907 A * 12/1999 Sato ..... B65D 75/5844 206/387.1
6,012,572 A * 1/2000 Heathcock ..... B65D 83/0894 206/233
6,015,934 A * 1/2000 Lee ..... A61F 13/15747 604/358
6,026,953 A * 2/2000 Nakamura ..... B65D 75/5838 206/233
6,028,289 A 2/2000 Robichaud
6,029,809 A 2/2000 Skiba
6,056,141 A * 5/2000 Navarini ..... B32B 27/06 220/269
6,060,095 A * 5/2000 Scrimager ..... B65D 75/5833 219/729
6,065,591 A * 5/2000 Dill ..... B65D 83/0805 206/233
6,066,437 A * 5/2000 Kosslinger ..... B32B 7/02 430/297
6,076,969 A * 6/2000 Jaisle ..... B65D 75/5855 383/211
6,077,551 A * 6/2000 Scrimager ..... B65D 75/5833 383/200
6,099,682 A * 8/2000 Krampe ..... B65D 75/5855 156/272.6
6,113,271 A * 9/2000 Scott ..... B65D 75/5838 206/494
6,125,614 A * 10/2000 Jones ..... A45D 40/0087 53/461
6,126,009 A * 10/2000 Shiffler ..... B65D 75/5838 206/233
6,126,317 A * 10/2000 Anderson ..... B65D 75/5827 229/87.05
6,128,317 A 10/2000 Anderson
6,152,601 A * 11/2000 Johnson ..... B32B 5/04 383/210
6,164,441 A * 12/2000 Guy ..... B65D 75/5838 206/210

(56) References Cited

U.S. PATENT DOCUMENTS 6,213,645 B1 * 4/2001 Beer ..... B65D 75/46 383/103
6,228,450 B1 * 5/2001 Pedrini ..... B65D 75/5838 428/40.1
D447,054 S * 8/2001 Hill ..... D9/434
6,273,610 B1 * 8/2001 Koyama ..... B65D 5/244 206/494
6,279,297 B1 * 8/2001 Latronico ..... B65B 61/18 53/139.2
6,296,884 B1 * 10/2001 Okerlund ..... A23G 3/563 426/104
6,299,355 B1 * 10/2001 Schneck ..... B65D 75/58 383/203
6,309,104 B1 * 10/2001 Koch ..... B65D 75/58 206/484
6,309,105 B1 * 10/2001 Palumbo ..... B65D 75/5838 206/494
6,318,894 B1 * 11/2001 Derenthal ..... B65D 33/2533 383/204
6,325,877 B1 12/2001 Murphy
6,352,364 B1 * 3/2002 Mobs ..... B65D 75/44 229/87.05
6,364,113 B1 * 4/2002 Faasse, Jr. ..... B65D 73/0057 206/459.1
6,365,255 B1 * 4/2002 Kittel ..... B32B 7/06 283/81
6,383,592 B1 * 5/2002 Lowry ..... B65D 31/02 206/459.5
6,402,379 B1 * 6/2002 Albright ..... B65D 75/5816 383/209
6,420,006 B1 * 7/2002 Scott ..... G09F 3/02 283/81
6,427,420 B1 * 8/2002 Olivieri ..... B23K 26/009 53/412
6,428,208 B1 * 8/2002 Addison ..... B65D 33/14 206/287
6,428,867 B1 * 8/2002 Scott ..... B32B 27/08 206/807
6,446,811 B1 * 9/2002 Wilfong, Jr. ..... B65D 33/001 206/554
6,450,685 B1 * 9/2002 Scott ..... B65D 81/3897 383/104
6,457,585 B1 * 10/2002 Huffer ..... B65D 33/004 206/459.5
6,461,043 B1 * 10/2002 Healy ..... B65D 33/2591 383/204
6,461,708 B1 * 10/2002 Dronzek ..... B32B 27/08 428/40.1
6,471,817 B1 * 10/2002 Emmert ..... B42D 15/0033 156/247
6,476,743 B1 * 11/2002 Brown ..... G06K 7/0166 235/449
6,482,867 B1 * 11/2002 Kimura ..... B01D 15/08 210/198.2
6,502,986 B1 * 1/2003 Bensur ..... B65D 33/20 383/204
6,517,243 B2 * 2/2003 Huffer ..... B65D 33/20 383/116
6,519,918 B2 * 2/2003 Forman ..... B29C 65/18 493/203
6,539,691 B2 4/2003 Beer
6,554,134 B1 * 4/2003 Guibert ..... B65D 75/5838 206/494
6,563,082 B2 * 5/2003 Terada ..... B23K 26/067 219/121.72
6,589,622 B1 * 7/2003 Scott ..... B65D 75/5838 206/807
6,592,260 B1 * 7/2003 Randall ..... B65D 33/2591 24/399
6,594,872 B2 * 7/2003 Cisek ..... B29D 5/10 24/389
6,612,432 B2 * 9/2003 Motson ..... A45F 5/00 206/305
6,616,334 B2 * 9/2003 Faaborg ..... B65D 75/5855 383/203
6,621,046 B2 * 9/2003 Kaji ..... B23K 26/0604 219/121.72
6,669,046 B1 * 12/2003 Sawada ..... B65D 77/206 220/270
6,691,886 B1 * 2/2004 Berndt ..... B29C 65/56 220/359.1
6,698,928 B2 3/2004 Miller
6,726,054 B2 4/2004 Fagen
6,726,364 B2 * 4/2004 Perell ..... B65D 75/5855 383/210
6,746,743 B2 6/2004 Knoerzer
6,750,423 B2 * 6/2004 Tanaka ..... B23K 26/0604 219/121.73
6,767,604 B2 * 7/2004 Muir, Jr. ..... B32B 7/06 428/40.1
6,815,634 B2 * 11/2004 Sonoda ..... B23K 26/067 219/121.63
6,821,388 B2 11/2004 Marsh
6,852,947 B2 * 2/2005 Tanaka ..... B23K 26/0604 219/121.76
6,865,860 B2 3/2005 Arakawa
6,865,960 B2 * 3/2005 Doemens ..... B60N 2/002 73/862.626
6,889,483 B2 5/2005 Compton
6,918,532 B2 7/2005 Sierra-Gomez
6,929,400 B2 8/2005 Razeti
6,932,135 B2 8/2005 Tabuchi
6,945,400 B2 9/2005 Bolnick
6,951,999 B2 * 10/2005 Monforton ..... B65D 75/5855 219/727
6,969,196 B2 11/2005 Woodham
6,983,875 B2 * 1/2006 Emmott ..... B65D 5/54 229/313
7,007,423 B2 * 3/2006 Andersson ..... B65D 75/5838 206/1.5
7,018,502 B2 3/2006 Treleaven
7,021,827 B2 4/2006 Compton
7,032,754 B2 * 4/2006 Kopecky ..... B65D 71/0085 206/460
7,032,757 B2 * 4/2006 Richards ..... B65B 11/58 206/525.1
7,032,810 B2 * 4/2006 Benedetti ..... B65D 77/32 229/125.15
7,040,810 B2 5/2006 Steele
7,048,441 B2 * 5/2006 Pape ..... B65B 43/123 383/37
7,051,877 B2 * 5/2006 Lin ..... B65D 75/5838 206/233
7,165,888 B2 1/2007 Rodick
7,172,779 B2 2/2007 Castellanos
7,207,718 B2 4/2007 Machacek
7,207,719 B2 4/2007 Marbler
7,213,710 B2 * 5/2007 Cotert ..... B65D 75/5838 206/494
7,228,968 B1 * 6/2007 Burgess ..... B65D 75/5838 206/233
7,254,873 B2 * 8/2007 Stolmeier ..... B32B 7/08 24/400
7,261,468 B2 * 8/2007 Schneider ..... B65D 33/2533 383/203
7,262,335 B2 * 8/2007 Motsch ..... B65D 75/5833 604/358
7,302,783 B2 12/2007 Cotert
7,344,744 B2 3/2008 Sierra-Gomez
7,350,688 B2 4/2008 Sierra-Gomez
7,351,458 B2 * 4/2008 Leighton ..... B65D 33/1691 428/126
7,352,591 B2 * 4/2008 Sugahara ..... B41J 2/14233 257/E23.098
7,371,008 B2 5/2008 Bonenfant
7,404,487 B2 * 7/2008 Kumakura ..... B65D 71/08 206/467
7,416,768 B2 8/2008 Knoerzer

(56) References Cited

U.S. PATENT DOCUMENTS 7,422,142 B2 * 9/2008 Arippol ..... B31D 1/021 206/459.5
7,470,062 B2 * 12/2008 Moteki ..... B65B 61/18 229/87.05
7,475,781 B2 * 1/2009 Kobayashi ..... B65D 75/5838 206/233
7,516,599 B2 * 4/2009 Doll ..... B65D 5/0209 493/152
7,527,189 B2 * 5/2009 Billig ..... B65D 5/6608 229/149
7,533,733 B2 5/2009 Nolan
7,533,773 B2 * 5/2009 Aldridge ..... B65D 5/5425 206/738
7,600,641 B2 10/2009 Burgess
7,703,602 B2 4/2010 Saito
7,708,463 B2 * 5/2010 Sampaio Camacho ..... B65D 33/1691 383/62
7,717,620 B2 * 5/2010 Hebert ..... B29C 59/007 383/203
7,740,923 B2 6/2010 Exner
7,744,517 B2 6/2010 Bonenfant
7,758,484 B2 * 7/2010 Peterson ..... B65D 75/30 493/210
7,858,901 B2 * 12/2010 Krishnan ..... B23K 26/0617 219/121.68
7,963,413 B2 6/2011 Sierra-Gomez
7,971,718 B2 * 7/2011 Aldridge ..... B65D 5/2057 206/37
8,002,171 B2 8/2011 Ryan
8,002,941 B2 8/2011 Exner
8,022,171 B2 * 9/2011 Goossens ..... D01F 6/04 264/291
8,022,941 B2 * 9/2011 Smoot ..... G06F 3/0425 178/18.01
8,029,428 B2 * 10/2011 Selle ..... B29C 59/007 493/194
8,038,349 B2 10/2011 Andersson
8,114,451 B2 2/2012 Sierra-Gomez
8,181,784 B2 5/2012 Bouthiette
8,240,546 B2 8/2012 Friebe
8,262,830 B2 9/2012 Hebert
8,262,832 B2 9/2012 Hebert
8,273,434 B2 9/2012 Zietlow
8,308,363 B2 11/2012 Vogt
8,408,792 B2 4/2013 Cole
8,506,165 B2 * 8/2013 Shinozaki ..... B65D 75/585 229/87.05
8,540,839 B2 9/2013 Zietlow
8,544,519 B2 10/2013 Ikeda
8,763,890 B2 * 7/2014 Clark ..... B32B 3/085 229/120.09
8,920,030 B2 * 12/2014 McSweeney ..... B65D 33/30 383/207
8,951,591 B2 2/2015 Vogt
8,986,803 B2 3/2015 Yoshida
8,999,100 B2 4/2015 Carmichael
2001/0000480 A1 * 4/2001 Stagg ..... B65D 33/16 428/43
2002/0000441 A1 * 1/2002 Redmond ..... B29C 51/08 220/266
2002/0068668 A1 * 6/2002 Chow ..... B31B 50/00 493/62
2002/0079247 A1 6/2002 Wilfong
2002/0182359 A1 12/2002 Muir, Jr.
2003/0002753 A1 1/2003 Stolmeier
2003/0019780 A1 * 1/2003 Parodi ..... B65D 33/24 206/524.1
2003/0039412 A1 * 2/2003 Rodick ..... B65D 33/1691 383/211
2003/0047695 A1 * 3/2003 Zik ..... B23K 26/0846 250/559.32
2003/0051440 A1 * 3/2003 Chow ..... B29C 59/007 53/412
2003/0053720 A1 * 3/2003 Smith ..... B65D 33/002 383/35
2003/0118255 A1 * 6/2003 Miller ..... B65D 75/5838 383/205
2003/0127352 A1 * 7/2003 Buschkiel ..... B65D 75/5838 206/494
2003/0170357 A1 * 9/2003 Garwood ..... A23B 4/16 426/392
2003/0180486 A1 9/2003 Pape
2003/0183637 A1 * 10/2003 Zappa ..... B26D 3/085 220/359.2
2003/0183643 A1 * 10/2003 Fagen ..... B65D 75/366 221/26
2003/0201083 A1 10/2003 Marsh
2003/0210838 A1 * 11/2003 Steele ..... B65D 33/08 383/66
2003/0217946 A1 * 11/2003 Hsu ..... B65D 83/0805 206/494
2003/0223656 A1 * 12/2003 Razeti ..... B65D 75/20 383/66
2004/0011677 A1 * 1/2004 Arakawa ..... B65B 9/2028 206/216
2004/0035719 A1 * 2/2004 Ebbers ..... B65D 75/58 206/1.5
2004/0060974 A1 * 4/2004 Dacey ..... B65D 5/543 229/225
2004/0062838 A1 * 4/2004 Castellanos ..... B65D 1/34 426/106
2004/0067326 A1 * 4/2004 Knoerzer ..... B32B 7/06 428/34.1
2004/0083680 A1 * 5/2004 Compton ..... B65B 9/02 53/133.6
2004/0086207 A1 5/2004 Marbler
2004/0091184 A1 5/2004 Miller
2004/0112010 A1 * 6/2004 Richards ..... B65D 75/18 53/415
2004/0112771 A1 6/2004 Bailey
2004/0150221 A1 * 8/2004 Brown ..... B65D 55/06 283/114
2004/0175060 A1 * 9/2004 Woodham ..... B65D 33/20 383/89
2004/0180118 A1 * 9/2004 Renger ..... B32B 27/08 426/106
2004/0206637 A1 * 10/2004 Sierra-Gomez .... B65D 75/5838 206/1.5
2005/0000965 A1 * 1/2005 Boardman ..... B65D 65/466 220/359.1
2005/0031233 A1 * 2/2005 Varanese ..... B65D 33/20 383/211
2005/0084186 A1 * 4/2005 Caris ..... B65D 75/5838 383/203
2005/0116016 A1 * 6/2005 Lo Duca ..... B65D 5/0254 229/121
2005/0117819 A1 * 6/2005 Kingsford ..... B65D 5/0236 383/203
2005/0186368 A1 8/2005 Leighton
2005/0220371 A1 * 10/2005 Machacek ..... B65D 33/2525 383/61.2
2005/0247764 A1 * 11/2005 Sierra-Gomez .... B65D 75/5838 229/87.08
2005/0276525 A1 12/2005 Robert
2005/0276885 A1 * 12/2005 Bennett ..... B65D 75/5805 426/118
2005/0284776 A1 12/2005 Kobayashi
2006/0000738 A1 1/2006 Kumakura
2006/0018569 A1 * 1/2006 Bonenfant ..... B65D 75/5838 383/5
2006/0066096 A1 * 3/2006 Kan ..... B65D 33/20 283/101
2006/0083446 A1 4/2006 SampaioCamacho
2006/0124494 A1 * 6/2006 Clark, Jr. ..... B65D 75/5833 206/440
2006/0144911 A1 * 7/2006 Sierra-Gomez .... B65D 75/5838 229/123.1

(56) References Cited

U.S. PATENT DOCUMENTS

2006/0147129 A1 7/2006 Miller
2006/0171611 A1* 8/2006 Rapparini ..... B65D 75/5838 383/66
2006/0199717 A1* 9/2006 Marbler ..... B65B 61/02 493/320
2006/0251342 A1* 11/2006 Forman ..... B65D 33/1691 383/62
2006/0257056 A1* 11/2006 Miyake ..... B65D 75/5805 383/103
2006/0257599 A1* 11/2006 Exner ..... B65D 75/5855 428/35.2
2006/0283750 A1* 12/2006 Villars ..... B65D 83/0805 206/494
2006/0285779 A1* 12/2006 Golas ..... B65D 33/165 383/90
2007/0023435 A1* 2/2007 Sierra-Gomez ..... B65D 77/206 220/359.2
2007/0023436 A1* 2/2007 Sierra-Gomez .... B65D 75/5838 220/359.2
2007/0095709 A1* 5/2007 Saito ..... A47K 10/421 206/494
2007/0116388 A1 5/2007 Kuge
2007/0140600 A1* 6/2007 Nowak ..... B32B 5/024 383/116
2007/0209959 A1 9/2007 Burgess
2007/0269142 A1* 11/2007 Tyska ..... A01K 7/00 383/38
2007/0275133 A1* 11/2007 Sierra-Gomez ..... B65D 75/44 426/122
2008/0013869 A1 1/2008 Forman
2008/0031555 A1* 2/2008 Roberts ..... B32B 5/142 383/210
2008/0034713 A1* 2/2008 Kohl ..... B65B 9/20 53/551
2008/0037911 A1* 2/2008 Cole ..... B65D 75/5838 383/203
2008/0041750 A1* 2/2008 Kohlweyer ..... B65D 75/5838 206/438
2008/0053861 A1* 3/2008 Mellin ..... B65D 75/5838 206/494
2008/0060751 A1* 3/2008 Arrindell ..... B65B 61/184 156/248
2008/0063324 A1* 3/2008 Bernard ..... B65D 75/5811 383/200
2008/0063759 A1* 3/2008 Raymond ..... B65B 29/08 426/127
2008/0063760 A1* 3/2008 Raymond ..... B65D 77/046 426/127
2008/0101733 A1* 5/2008 Fenn-Barrabass ... B65D 75/008 383/104
2008/0131035 A1* 6/2008 Rogers ..... B65D 75/5827 383/203
2008/0135428 A1* 6/2008 Tallier ..... B65D 75/5827 206/264
2008/0152264 A1* 6/2008 Pokusa ..... B65B 9/067 383/5
2008/0156861 A1* 7/2008 Sierra-Gomez .... B65D 75/5838 229/214
2008/0159666 A1* 7/2008 Exner ..... B65D 75/5855 383/203
2008/0199109 A1* 8/2008 Rutzinger ..... B65D 75/5838 383/81
2008/0203141 A1* 8/2008 Friebe ..... B41M 1/22 229/87.05
2008/0214376 A1 9/2008 Bonenfant
2008/0220227 A1* 9/2008 Keeney ..... B32B 27/18 428/203
2008/0240627 A1* 10/2008 Cole ..... B65D 75/5838 383/204
2008/0273821 A1* 11/2008 Doll ..... B65B 9/2028 383/209
2008/0292225 A1* 11/2008 Dayrit ..... B32B 27/08 383/207
2009/0001143 A1* 1/2009 Cowan ..... B65D 75/5827 229/87.05
2009/0014491 A1* 1/2009 Fuisz ..... B65D 75/5805 225/1
2009/0022431 A1* 1/2009 Conner ..... B65D 33/00 383/37
2009/0028472 A1* 1/2009 Andersson ..... B65D 75/44 383/205
2009/0053372 A1* 2/2009 Hambrick ..... C09J 7/385 426/125
2009/0074333 A1* 3/2009 Griebel ..... B65D 75/008 383/200
2009/0097786 A1* 4/2009 Goglio ..... B65D 75/008 383/211
2009/0161995 A1* 6/2009 Henderson ..... B65D 75/5833 383/210
2009/0190866 A1* 7/2009 Hughes ..... B65D 75/44 383/207
2009/0211938 A1 8/2009 Aldridge
2009/0226117 A1* 9/2009 Davis ..... B29C 59/007 383/5
2009/0232425 A1* 9/2009 Tai ..... B65D 75/5838 383/211
2009/0273179 A1* 11/2009 Scott ..... B65D 75/5838 283/81
2009/0301903 A1 12/2009 Andersson
2009/0304875 A1 12/2009 Zerfas et al.
2010/0002963 A1* 1/2010 Holbert ..... B65D 75/5838 383/204
2010/0018974 A1* 1/2010 Lyzenga ..... B65D 75/5838 220/214
2010/0019022 A1* 1/2010 Ryan ..... B65D 5/563 229/122
2010/0111453 A1* 5/2010 Dierl ..... B65B 9/213 383/204
2010/0113241 A1 5/2010 Herbert
2010/0147724 A1* 6/2010 Mitra-Shah ..... B65D 75/5833 206/459.1
2010/0172604 A1* 7/2010 Andersson ..... B65D 75/366 383/211
2010/0226598 A1* 9/2010 Stoeppelmann ..... B65D 31/02 383/207
2010/0230303 A1* 9/2010 Buse ..... B65D 5/38 206/268
2010/0230411 A9 9/2010 Sierra-Gomez
2010/0278454 A1* 11/2010 Huffer ..... B65D 75/5838 383/5
2010/0303391 A9 12/2010 Cole
2011/0049158 A1* 3/2011 Bouthiette ..... B65D 75/327 220/359.3
2011/0058755 A1* 3/2011 Guibert ..... B65D 33/1691 383/42
2011/0127319 A1* 6/2011 Golden ..... B65B 9/067 229/123.1
2011/0132976 A1* 6/2011 Drewnowski ..... A61F 13/15747 229/87.05
2011/0147443 A1* 6/2011 Igo ..... B65D 75/5838 229/117.31
2011/0204056 A1* 8/2011 Veternik ..... B65D 75/5844 220/270
2011/0253718 A1 10/2011 Sierra-Gomez
2012/0125932 A1 5/2012 Sierra-Gomez
2012/0128835 A1* 5/2012 Lyzenga ..... B65B 9/20 426/122
2012/0177307 A1* 7/2012 Duan ..... B65D 75/5833 383/211
2013/0004626 A1* 1/2013 Renders ..... B65D 33/02 426/121
2013/0011527 A1* 1/2013 Renders ..... B65D 75/5838 426/124
2013/0064477 A1 3/2013 Vogt
2013/0064934 A1 3/2013 Vogt
2013/0114918 A1* 5/2013 Lyzenga ..... B65B 9/067 383/203

(56) References Cited

U.S. PATENT DOCUMENTS

| | | | | |
|---|---|---|---|---|
| 2013/0121623 | A1* | 5/2013 | Lyzenga | B65B 9/207 383/203 |
| 2013/0121624 | A1* | 5/2013 | Lyzenga | B65B 9/067 383/203 |
| 2013/0205964 | A1 | 8/2013 | Matsushita | |
| 2013/0270268 | A1 | 10/2013 | Lyzenga | |
| 2014/0185965 | A1* | 7/2014 | Lyzenga | B65B 61/02 383/99 |
| 2014/0270597 | A1* | 9/2014 | Friedman | B65D 75/5855 383/203 |
| 2014/0314339 | A1 | 10/2014 | Docherty | |
| 2015/0016756 | A1* | 1/2015 | Down | B65D 75/5833 383/203 |
| 2015/0021219 | A1* | 1/2015 | Seyfferth De Oliveira | B65D 85/1045 206/268 |

FOREIGN PATENT DOCUMENTS

| | | | |
|---|---|---|---|
| AU | 2004295316 | | 6/2005 |
| AU | 2005254459 | | 12/2005 |
| AU | 2006337982 | | 8/2007 |
| AU | 2007309154 | | 5/2008 |
| AU | 2008223524 | | 9/2008 |
| AU | 2008229190 | | 9/2008 |
| BR | 55008852 | | 11/2001 |
| BR | 62020307 | | 4/2003 |
| BR | 68046367 | | 10/2009 |
| CN | 1224396 | A | 7/1999 |
| CN | 1781819 | A | 6/2006 |
| DE | 1848870 | | 3/1962 |
| DE | 3700988 | A1 | 7/1988 |
| DE | 3835721 | A1 | 5/1990 |
| DE | 9003401 | | 5/1990 |
| DE | 9005297 | | 8/1990 |
| DE | G90140656 | | 4/1991 |
| DE | 4134567 | | 1/1993 |
| DE | 4241423 | | 6/1994 |
| DE | 19738411 | | 3/1999 |
| DE | 19822328 | A1 | 11/1999 |
| DE | 20113173 | U1 | 10/2001 |
| DE | 202004012301 | | 12/2004 |
| DE | 20122333 | | 3/2005 |
| DE | 202007005487 | | 6/2007 |
| DE | 102007030267 | A1 | 1/2009 |
| DE | 202009000302 | | 3/2009 |
| DE | 102010019867 | A1 | 9/2011 |
| EP | 0085289 | | 8/1983 |
| EP | 0298054 | A2 | 1/1989 |
| EP | 0307924 | A2 | 3/1989 |
| EP | 0388310 | | 9/1990 |
| EP | 0396967 | A2 | 11/1990 |
| EP | 408831 | A1 | 1/1991 |
| EP | 0447636 | | 9/1991 |
| EP | 0474981 | A1 | 3/1992 |
| EP | 0488967 | | 6/1992 |
| EP | 0546369 | | 6/1993 |
| EP | 0667828 | | 5/1994 |
| EP | 0608909 | | 8/1994 |
| EP | 0613824 | | 9/1994 |
| EP | 0629561 | A2 | 12/1994 |
| EP | 0661154 | | 7/1995 |
| EP | 0669204 | B2 | 8/1995 |
| EP | 0744357 | | 11/1996 |
| EP | 0752375 | | 1/1997 |
| EP | 0758993 | | 2/1997 |
| EP | 0796206 | | 9/1997 |
| EP | 0796208 | | 9/1997 |
| EP | 0905048 | A | 3/1999 |
| EP | 1010638 | A1 | 6/2000 |
| EP | 1046594 | | 10/2000 |
| EP | 1056066 | | 11/2000 |
| EP | 1086906 | A2 | 3/2001 |
| EP | 1136379 | | 9/2001 |
| EP | 1288139 | | 3/2003 |
| EP | 1318081 | A1 | 6/2003 |
| EP | 1350741 | | 10/2003 |
| EP | 1375380 | A1 | 1/2004 |
| EP | 1382543 | A2 | 1/2004 |
| EP | 1437311 | A1 | 7/2004 |
| EP | 1449789 | A1 | 8/2004 |
| EP | 1457424 | | 9/2004 |
| EP | 1467929 | | 10/2004 |
| EP | 1468936 | | 10/2004 |
| EP | 1477425 | A1 | 11/2004 |
| EP | 1488936 | | 12/2004 |
| EP | 1608567 | | 12/2005 |
| EP | 1609737 | | 12/2005 |
| EP | 1619137 | | 1/2006 |
| EP | 1619137 | A1 | 1/2006 |
| EP | 1637472 | A1 | 3/2006 |
| EP | 1697230 | | 9/2006 |
| EP | 1351861 | | 10/2006 |
| EP | 1712468 | | 10/2006 |
| EP | 1712488 | A1 | 10/2006 |
| EP | 1755980 | | 2/2007 |
| EP | 1760006 | A1 | 3/2007 |
| EP | 1770025 | | 4/2007 |
| EP | 1846306 | | 10/2007 |
| EP | 1858776 | | 11/2007 |
| EP | 1873082 | A1 | 1/2008 |
| EP | 1908696 | | 4/2008 |
| EP | 1939107 | | 7/2008 |
| EP | 1975081 | A1 | 10/2008 |
| EP | 2033910 | | 3/2009 |
| EP | 2189506 | | 5/2010 |
| FR | 1327914 | A | 5/1963 |
| FR | 2674509 | | 10/1992 |
| FR | 2693988 | | 1/1994 |
| FR | 2766794 | | 2/1999 |
| FR | 2772009 | | 6/1999 |
| FR | 2783512 | | 3/2000 |
| GB | 1107200 | | 3/1968 |
| GB | 2171077 | | 8/1986 |
| GB | 2266513 | | 11/1993 |
| GB | 2276095 | A | 9/1994 |
| GB | 2335652 | A | 9/1999 |
| GB | 2339187 | A | 1/2000 |
| JP | 57163658 | | 10/1982 |
| JP | S5822411 | B2 | 2/1983 |
| JP | 6080405 | | 5/1985 |
| JP | 62171479 | | 10/1987 |
| JP | 63022370 | | 1/1988 |
| JP | 01167084 | A | 6/1989 |
| JP | 01226579 | A | 9/1989 |
| JP | 01267182 | A | 10/1989 |
| JP | H0581083 | | 11/1993 |
| JP | 09142551 | A | 6/1997 |
| JP | 09150872 | | 6/1997 |
| JP | H09156677 | A | 6/1997 |
| JP | 1059441 | | 3/1998 |
| JP | 10059441 | | 3/1998 |
| JP | 10120016 | A | 5/1998 |
| JP | 10129685 | | 5/1998 |
| JP | H10167355 | | 6/1998 |
| JP | H10152179 | A | 9/1998 |
| JP | H10509406 | | 9/1998 |
| JP | H0444968 | | 2/1999 |
| JP | 11198977 | | 7/1999 |
| JP | H11343468 | | 12/1999 |
| JP | 2000335542 | A | 12/2000 |
| JP | 2001114357 | | 4/2001 |
| JP | 2001301807 | | 10/2001 |
| JP | 2002002805 | A | 1/2002 |
| JP | 2002104550 | A | 4/2002 |
| JP | 200326224 | | 1/2003 |
| JP | 2003026224 | A | 1/2003 |
| JP | 2003072774 | | 3/2003 |
| JP | 2003137314 | | 5/2003 |
| JP | 2005015015 | | 1/2005 |
| JP | 200602767 | | 2/2006 |
| JP | 2006062712 | | 3/2006 |
| JP | 2006137445 | A | 6/2006 |

(56) References Cited

FOREIGN PATENT DOCUMENTS

| | | | |
|---|---|---|---|
| JP | 2006199343 | | 8/2006 |
| JP | 2007045434 | | 2/2007 |
| JP | 2008105751 | | 5/2008 |
| JP | 2009166870 | | 7/2009 |
| NZ | 555274 | | 12/2008 |
| WO | 1984000716 | | 3/1984 |
| WO | 8606350 | | 11/1986 |
| WO | 9104920 | | 4/1991 |
| WO | 9411270 | A1 | 5/1994 |
| WO | 1994011270 | | 5/1994 |
| WO | 9424019 | A2 | 10/1994 |
| WO | 9532902 | A1 | 12/1995 |
| WO | 9725200 | | 7/1997 |
| WO | 1997025200 | | 7/1997 |
| WO | 0061458 | A | 10/2000 |
| WO | 0064755 | | 11/2000 |
| WO | 0140073 | A1 | 6/2001 |
| WO | 02066341 | | 8/2002 |
| WO | 2002064365 | A1 | 8/2002 |
| WO | 03013976 | A1 | 2/2003 |
| WO | 03037727 | | 5/2003 |
| WO | 2003035504 | | 5/2003 |
| WO | 03059776 | A1 | 7/2003 |
| WO | 2003059776 | | 7/2003 |
| WO | 2004087527 | A1 | 10/2004 |
| WO | 2005054079 | | 6/2005 |
| WO | 2005056420 | | 6/2005 |
| WO | 2005110042 | | 11/2005 |
| WO | 2005110865 | | 11/2005 |
| WO | 2005110876 | | 11/2005 |
| WO | 2005110885 | A2 | 11/2005 |
| WO | 2005120989 | | 12/2005 |
| WO | 2005123535 | A1 | 12/2005 |
| WO | 2006055128 | A2 | 5/2006 |
| WO | 2006080405 | | 8/2006 |
| WO | 2006108614 | | 10/2006 |
| WO | 2007079071 | A1 | 7/2007 |
| WO | 2007090419 | | 8/2007 |
| WO | 2008051813 | | 5/2008 |
| WO | 2008062159 | A1 | 5/2008 |
| WO | 2008074060 | | 6/2008 |
| WO | 2008108969 | | 9/2008 |
| WO | 2008115693 | A1 | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010051146 | A2 | 5/2010 |
| WO | 2010080810 | | 7/2010 |
| WO | 2010084336 | A1 | 7/2010 |
| WO | 2010088492 | A1 | 8/2010 |
| WO | 2010114879 | A1 | 10/2010 |
| WO | 2010149996 | A1 | 12/2010 |
| WO | 2011004156 | A2 | 1/2011 |
| WO | 2011032064 | | 3/2011 |
| WO | 2011121337 | A2 | 10/2011 |
| WO | 2011123410 | | 10/2011 |
| WO | 2011146616 | | 11/2011 |
| WO | 2011146627 | | 11/2011 |
| WO | 2011146658 | | 11/2011 |
| WO | 2012036765 | | 3/2012 |
| WO | 2012098412 | | 7/2012 |

OTHER PUBLICATIONS

'Elite Edam Cheese', Mintel gnpd, Dec. 3, 2001, Mintel Publishing, 2 pages.

'Margin.' Merriam-Webster Online Dictionary. 2010. Merriam-Webster [online], retrieved on May 6, 2010, Retrieved from the internet:URL: http://www.merriam-webster.com/dictionary/margin, 3 pages.

'New Easy Peel Cheese Packaging', Mintel gnpd, Aug. 10, 2001, Mintel Publishing.

'New on the Shelf-Product Instructions and Packaging Trends', Circle Reader Service Card No. 93, Aug. 1998, Baking & Snack.

'Soft Bread Sticks', Mintel gnpd, Mar. 20, 1998, Mintel Publishing, 1 page.

"Wall's Bacon □ A Sizzling Success Story" and The Grocer: "When sealed delivers", the second page of which bears a date of Aug. 21, 1999.

40 Packaging News PPMA Preview Sep. 2001.

Additional Exhibits from Declaration of James Lukas Jr. filed Mar. 26, 2015, 73 pages.

Brief of Defendants-Cross-Appellants; dated Jun. 17, 2016; 86 pages, filed with the Federal Circuit in Case Nos. 2015-2082, -2084.

Declaration of James J. Lukas, Jr. in Support of Defendants' Motion for Summary Judgment with Exhibits, Part 1 dated Mar. 23, 2015, 277 pages.

Declaration of James J. Lukas, Jr. in Support of Defendants' Opposition to Plaintiff's Motions for Summary Judgment with Exhibits (redacted), dated May 28, 2015, 228 pages.

Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.

Declaration of Katie Crosby Lehmann in Support of Plaintiff's Reply in Support of its Motions for Summary Judgment and Exhibit (unsealed), dated Jun. 10, 2015, 8 pages.

Defendant's Local Rule 56.1 Statement of Material Facts in Support of Motion for Summary Judgment, dated Mar. 23, 2015, 75 pages.

Defendants' Answer, Affirmative Defenses, and Counterclaims Responsive to Complaint, dated Apr. 5, 2013, 25 pages.

Defendants' Consolidated Memorandum in Support of Motion for Summary Judgment (redacted) with Exhibits A-G, dated Mar. 23, 2015, 166 pages.

Defendants' Consolidated Reply in Support of Defendants' Motion for Summary Judgment with Exhibits, dated May 28, 2015, 36 pages.

Defendants' Final Invalidity Contentions—Exhibit A-1, dated Sep. 27, 2013, 55 pages.

Defendants' Final Invalidity Contentions—Exhibit A-2, dated Sep. 27, 2013, 35 pages.

Defendants' Final Invalidity Contentions—Exhibit A-3, dated Sep. 27, 2013, 34 pages.

Defendants' Final Invalidity Contentions—Exhibit A-4, dated Sep. 27, 2013, 35 pages.

Defendants' Final Invalidity Contentions—Exhibit B-1, dated Sep. 27, 2013, 135 pages.

Defendants' Final Invalidity Contentions—Exhibit B-2, dated Sep. 27, 2013, 64 pages.

Defendants' Final Invalidity Contentions—Exhibit B-3, dated Sep. 27, 2013, 140 pages.

Defendants' Final Invalidity Contentions—Exhibit B-4, dated Sep. 27, 2013, 273 pages.

Defendants' Final Invalidity Contentions—Exhibit B-5, dated Sep. 27, 2013, 146 pages.

Defendants' Final Invalidity Contentions—Exhibit B-6, dated Sep. 27, 2013, 226 pages.

Defendants' Final Invalidity Contentions Pursuant to LPR 3.1, dated Sep. 27, 2013, 22 pages.

Defendants' Final Unenforceability Contentions Pursuant to LPR 3.1, dated Sep. 27, 2013, 14 pages.

Defendants' Initial Non-Infringement Contentions Pursuant to LPR 2.3(a), dated May 17, 2013, 7 pages.

Defendants' Invalidity Contentions—Exhibit A-2, dated May 17, 2013, 35 pages.

Defendants' Invalidity Contentions—Exhibit A-3, dated May 17, 2013, 34 pages.

Defendants' Invalidity Contentions—Exhibit A-4, dated May 17, 2013, 35 pages.

Defendants' Invalidity Contentions—Exhibit A-5, dated May 17, 2013, 39 pages.

Defendants' Invalidity Contentions Pursuant to LPR 2.3, dated May 17, 2013, 23 pages.

(56) References Cited

OTHER PUBLICATIONS

Defendants' Invalidity Contentions—Exhibit A-1, dated May 17, 2013, 55 pages.
Defendants' Local Rule 56.1 Statement of Material Facts in Support of Motion for Summary Judgment (redacted), dated Mar. 23, 2015, 75 pages.
Defendants' LPR 2.3 Initial Non-Infringement Contentions Exhibit A, dated May 17, 2013, 39 pages.
Defendants' LR 56.1 (b) (3) (C) Statement of Additional Material Facts in Support of Their Opposition to Plaintiff's Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Memorandum in Support of Their Motion to Compel Discovery, dated Oct. 13, 2014, 13 pages.
Defendants' Motion for Summary Judgment of Non-Infringement and Motion for Summary Judgment of Invalidity Under 35 U.S.C. 102 and/or 103, dated Mar. 23, 2015, 4 pages.
Defendants' Motion to Compel Discovery, dated Oct. 13, 2014, 3 pages.
Defendants' Response to Plaintiff's Local Rule 56.1 Statement of Material Facts in Support of Plaintiff's Motions for Summary Judgment, dated May 28, 2015, 108 pages.
Defendants' Supplemental Memorandum of Law Regarding Additional Claim Construction Authority Requested by the Court, dated Feb. 28, 2014, 13 pages.
Defendants' Unenforceability Contentions Pursuant to LPR 2.3, dated May 17, 2013, 13 pages.
Definition of "end." Webster's New World Dictionary, Third College Edition. 1988 Simon & Schuster, cited by USPTO in U.S. Appl. No. 11/193,614, dated Jan. 21, 2016, 3 pages.
Derrien, Y.; European Search Report, PCT/US2011/036998 dated Sep. 14, 2011; 3 pgs.
Derrien, Y.; European Search Report, PCT/US2011/037010 dated Sep. 14, 2011; 3 pgs.
Derrien, Y.; European Search Report, PCT/US2011/037054 dated Sep. 14, 2011; 2 pgs.
English Translation of Brazilian Office Action dated Nov. 6, 2018, in related Brazilian Application No. PI0902473-5 (4 pages).
English Translation of Japanese Official Notice of Rejection dated Feb. 14, 2012 in JP Application No. 2009-172352, citing Japanese Laid Open Application No. 62-171479, 3 pages.
English Translation of Japanese Unexamined Application Publication No. H9-156677, published Jul. 17, 1997; 6 pages.
English Translation of JP 1998-152179 (H10-152179 A), published on Sep. 6, 1998, 6 pages.
English Translation of JP 2001-114357 published on Apr. 24, 2001, 8 pages.
English Translation of JP 2003-26224 published on Jan. 29, 2003, 13 pages.
English Translation of JP H09-156677 published on Jun. 17, 1997, 2 pages.
English Translation of JP Official Notice of Rejection dated Jan. 29, 2013 in JP Appl. No. 2008-087152 citing JPH0581083, 5 pages.
English Translation of JP S60-80405 published Aug. 5, 1985; 21 pgs.
English Translation of JP2001-301807 published Oct. 31, 2001, translated on Jul. 27, 2015. Translation provided by USPTO in U.S. Appl. No. 14/175,434, 6 pages.
English Translation of JP2002-002805 filed by Onuma, published Sep. 1, 2012, translation provided by the USPTO in U.S. Appl. No. 11/193,614.
English Translation of JP2003-026224 published Jan. 29, 2003, translated on Jul. 27, 2015. Translation provided by USPTO in U.S. Appl. No. 14/175,434, 9 pages.
English Translation of JP2006137445 filed by Shimomura, published Jun. 1, 2006, translation provided by the USPTO in U.S. Appl. No. 13/698,567, 18 pages.
European Extended Search Report for Application No. 16180214.5, dated Sep. 26, 2016, 7 pages.
European Packaging Pack Report, NR. May 5, 2001 and partial translation thereof, 6 pages.
European Patent Office Partial Search Report; EP04252257 dated Aug. 4, 2004; 5 pages.
European Patent Office Partial Search Report; EP10181886 dated Dec. 14, 2010; 7 pages.
European Patent Office Search Report and Opinion; EP10181784 dated Mar. 9, 2011; 7 pages.
European Patent Office Search Report and Opinion; EP10181886 dated Apr. 5, 2011; 12 pages.
European Patent Office Search Report; EP04252257 dated Oct. 21, 2004; 5 pages.
European Patent Office; First Communication; EP04252257 dated Jan. 24, 2008; 5 pages.
European Patent Office; Second Communication; EP04252257 dated Sep. 24, 2009; 4 pages.
European Patent Office; Third Communication; EP04252257 dated Nov. 8, 2010; 3 pages.
European Search Report 06118142.6 dated May 3, 2007, citing DE90140656, 10 pages.
European Search Report for EP 10305091 dated Apr. 30, 2010.
European Search Report, EP10305289 citing DE1848870U, 3 pages.
Exhibits from Defendants' Memorandum in Support of Their Motion to Compel Discovery, dated Oct. 13, 2014, 68 pages.
Exhibits from Plaintiff's Memorandum of Law in Opposition to Defendants' Motion to Compel Discovery, Oct. 15, 2014, 78 pages.
Exhibits, part 2, to Declaration of James J. Lukas, Jr. in Support of Defendants' Motion for Summary Judgment, dated Mar. 23, 2015 125 pages.
Exhibits, part 2, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 3, to Declaration of James J. Lukas, Jr. in Support of Defendants' Motion for Summary Judgment, dated Mar. 23, 2015, 125 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4 to Declaration of James J. Lukas, Jr. in Support of Defendants' Motion for Summary Judgment with Exhibits, dated Mar. 23, 2015, 28 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted), dated May 8, 2015, 136 pages.
Fuji Packaging GmbH Fachpack brochure, Oct. 11-12, 2001; 2 pages.
Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.
Global Brands' LPR 2.5 Initial Response to Defendants' Initial Invalidity Contentions Chart Ex. A-1, dated May 31, 2013, 30 pages.

(56) References Cited

OTHER PUBLICATIONS

Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-5, dated May 31, 2013, 14 pages.
Global Brands LPR 2.5 Initial Response to Defendants' Initial Invalidity Contentions Chart Ex. A-4, dated May 31, 2013, 17 pages.
Indian Office Action dated Sep. 24, 2018, in related Indian Application No. 10393/CHENP/2012 (6 pages).
International Search Report for PCT/EP2011/051008 dated Apr. 13, 2011.
International Search Report, PCT/EP2011/054250 dated Jun. 28, 2011, 3 pages.
Kellogg's Opening Claim Construction Brief, dated Dec. 13, 2013, 30 pages.
Kellogg's Reply Claim Construction Brief, dated Jan. 24, 2014, 19 pages.
Kellogg's Response to Plaintiff's Surreply Claim Construction Brief Pursuant to Docket No. 98, dated Feb. 28, 2014, 9 pages.
Machine translation of claim for BR 5500885-2 from Googletranslate.com; 1 page.
Machine translation of claim for BR 6202030-7 from Googletranslate.com; 1 page.
Machine translation of claim for BR 6804636-7 from Googletranslate.com; 1 page.
Machine translation of CN 1781819A published Jun. 7, 2006 from google.com/patents; 13 pages, accessed Jun. 5, 2014.
Machine translation of DE 1848870 classification. Translated on Sep. 7, 2017. 4 pages.
Machine translation of DE 202007005487, published Jun. 14, 2007, provided by Espacenet, 3 pages.
Machine translation of DE 202009000302, published Mar. 19, 2009, provided by Espacenet, 9 pages.
Machine translation of DE 9005297 description. Translated on Sep. 7, 2017. 4 pages.
Machine translation of DE9014065, published Mar. 19, 2009, provided by Espacenet, 9 pages.
Machine Translation of EP 1449789 description. Translated on Jun. 13, 2015, 18 pages.
Machine Translation of the description of DE 3835721. Translation provided by USPTO in U.S. Appl. No. 14/005,783, dated Jan. 21, 2016, 17 pages.
Machinery Update, Mar./Apr. 2002, pp. 56-62.
Machinery Update, Mar./Apr. 2002, pp. 59-60.
Machinery Update, Sep./Oct. 2001, pp. 46-47.
Non-Confidential Brief for Plaintiff-Appellant Intercontinental Great Brands LLC, dated Dec. 30, 2015, 149 pages, filed with the Federal Circuit in Case Nos. 2015-2082, -2084 (litigation related to U.S. Pat. No. 6,918,532).
Non-Confidential Responsive/Reply Brief for Plaintiff-Appellant Intercontinental Great Brands LLC, dated Sep. 30, 2016; 69 pages, filed with the Federal Circuit in Case Nos. 2015-2082, -2084.
Opposition to EP1679269 filed by Awapatent AB, Helsingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, citing DE9003401 and DE9005297, 9 pages.
Patent Abstracts of Japan, vol. 1997 No. 10, Oct. 31, 1997 and JP09156677 A (Fuji Seal Co. Ltd.) (Jun. 17, 1997) abstract in English and 7 figures.
Plaintiff Intercontinental Great Brands LLC's Responsive Claim Construction Brief Pursuant to LPR 4.2, dated Feb. 10, 2014, 27 pages.
Plaintiff Intercontinental Great Brands LLC's Submission of Authority Pursuant to Docket No. 98, dated Feb. 28, 2014, 11 pages.
Plaintiff Intercontinental Great Brands LLC's Surreply Claim Construction Brief Pursuant to Docket No. 98, dated Feb. 21, 2014, 6 pages.
Plaintiffs Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiff's Initial Response to Defendant's Initial Invalidity Contentions, dated May 31, 2013, 20 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Memorandum of Law in Opposition to Defendants' Motion to Compel Discovery, Oct. 15, 2014, 12 pages.
Plaintiff's Reply in Support of its Motions for Summary Judgment, dated Jun. 1, 2015, 19 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Reply Brief of Defendants-Cross-Appellants; dated Oct. 14, 2016, 37 pages, filed with the Federal Circuit in Case Nos. 2015-2082, -2084.
Reseal-It. Web page Internet print out accessed Mar. 14, 2005; 19 pages.
Response to First Communication from the European Patent Office; EP04252257; dated Jun. 4, 2008; 19 pages.
Response to Second Communication from the European Patent Office; EP04252257; dated Mar. 26, 2010; 8 pages.
Response to Third Communication from the European Patent Office; EP04252257; dated Mar. 8, 2011; 6 pages.
U.S. Appl. No. 11/500,497, Cole et al.
U.S. District Court for the Northern District of Illinois, Eastern Division Memorandum Opinion and Order, dated Sep. 22, 2014, 12 pages.
U.S. District Court for the Northern District of Illinois, Eastern Division, Memorandum Opinion and Order, dated Aug. 3, 2015, 37 pages.
English Translations of JP H09-156677 (25 pages).
European Patent No. 1679269 opposition documents, dated Apr. 30, 2012.
European Patent No. 1679269 opposition documents, dated May 2, 2012.

* cited by examiner

PACKAGE INTEGRITY INDICATING CLOSURE

This application is a divisional of U.S. application Ser. No. 13/721,548, filed Dec. 20, 2012, now issued as U.S. Pat. No. 10,118,741, which is a continuation of U.S. application Ser. No. 12/179,103, filed Jul. 24, 2008, both of which are incorporated herein by reference in their entirety.

FIELD OF THE INVENTION

The present invention relates to a resealable closure for packages storing articles and, more particularly, packages with resealable closures having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays, which are sealed on the top using some type of lidding material. One recent advancement in the art of food container closures includes a resealable closure disclosed in U.S. Pat. No. 6,918,532 (hereinafter "the '532 patent"), herein incorporated by reference, which discloses a wrapper which forms a top of the container, which top has an access opening covered by a resealable sealing panel.

In the packaging art, different structures have been used to indicate whether a package has been previously opened or whether the integrity of the package has been compromised, which structures are often referred to in the art as "tamper-evident" or "package integrity." For example, one recent package integrity indicating closure is disclosed in U.S. patent application Ser. No. 11/500,497 (hereinafter "the '497 application"), herein incorporated by reference, shows a closure comprising a two-ply material having an inner film layer and an outer film layer forming a top of a container. The outer film layer has a sealing panel covering a portion of the inner film layer which, with the sealing panel, forms an opening. The package integrity feature comprises a panel of the inner film layer which separates from the sealing panel to indicate that the closure has been previously opened.

One recent advancement in the art of food containers having a package integrity feature is disclosed in U.S. patent application Ser. No. 11/693,751 (hereinafter "the '751 application"), herein incorporated by reference. The '751 application discloses a resealable closure having a package integrity indicator provided by a structure which breaks and/or produces an audible sound when the resealable closure is opened for a first time. The package integrity feature includes at least one strip initially affixed to two portions which comprise the resealable closure so that upon opening the resealable closure for a first time, at least one of the strips breaks, thereby indicating that the package has previously been opened. Package integrity is also provided by a movable panel or removable die-cut tab portions which are misaligned upon resealing of the closure, thus indicating that the package has previously been opened.

In the packaging art of non-food items, different methods have been used to indicate whether a package has previously been opened or whether the integrity of the package has been compromised, including the methods disclosed in U.S. Pat. Nos. 6,589,622; 6,767,604; and 4,679,693. U.S. Pat. No. 6,589,622 discloses a tamper-evident feature in the form of a label flap having a series of perforations which form a tamper indicating tab, such that when the label flap is initially removed from the package, the tamper indicating tab separates from the label flap along the perforations to indicate that the package has been opened. Similarly, in U.S. Pat. No. 6,767,604, package integrity is indicated by a label with pull tab having a pull tab perforation or other weakened portion which divides the tab into a pull portion and an end portion.

U.S. Pat. No. 4,679,693 discloses a main pull tab adhesively sealed to a top surface of a package with an auxiliary pull tab which is completely removed from the main tab prior to opening the container.

There is a need in the art for a resealable container, preferably suitable for containing food items, which includes a new and improved package integrity indicator.

BRIEF SUMMARY OF THE INVENTION

The present invention generally relates to a resealable closure for a container in which package integrity is indicated by a structure which has to be broken prior to gaining access to the contents in the container. Accordingly, an intact structure indicates package integrity, thereby providing an indication that the package has not previously been opened.

The present package integrity feature can be used by itself to indicate package integrity or it can complement the package integrity features disclosed in the '751 application. When used with the package integrity features of the '751 application, the present new package integrity feature further ensures that the closure cannot be even initially partially opened for a first time without the present integrity feature having first been broken, and thus visible by observing the exterior of the container.

The present invention, in one form, relates to a package integrity feature comprising a closure, covering an opening into a container, and at least one structure associated with the closure, connecting the closure to a remaining portion of the container. Upon opening the closure for a first time, the structure stretches, increasing a length of the structure until the structure eventually breaks, leaving one or both residual ends of the broken structure rippled or curved upward from the remaining portion of the container. In various alternative further embodiments, the structure may comprise a strip extending from a tab portion of the closure to the remaining portion of the container. In yet a further alternative embodiment, there may be at least two structures associated with the closure, one on either side of a tab portion of the closure.

Advantageously, the structure is integrally formed with the closure and the remaining portion of the container, and the closure is in the form of a sealing panel, wherein the sealing panel is releasable from the remaining portion of the container by pulling back in a peeling direction, thereby stretching the structure associated with the sealing panel and eventually breaking the structure to gain access to the contents inside. The sealing panel is reclosable against the remaining portion of the container to seal the opening when the sealing panel is moved back against the remaining portion of the container.

The present invention, in another form thereof, relates to a package integrity feature comprising at least one structure associated with the sealing panel of a resealable closure of a container. The structure is integrally formed with the sealing panel on one end and a remainder of the container on the other end. The structure is constructed to break its connection between the sealing panel and the remainder of the container when the sealing panel is pulled back from the remainder of the container for a first time, thereby leaving the sealing panel free of its attachment to the container through the structure.

In various further alternative forms, the breakable structure comprises a curved strip, such as a strip in the shape of an arc or a wavy shape having a concave segment and a convex segment, a structure having one or more narrowing segments followed with one or more broader or wider segments, whereby the structure stretches along the narrow portion and eventually breaks.

The present invention, in another form thereof, relates to an integrity indicating closure for a container, the closure comprising an at least two-ply material comprising an inner layer adhesively joined to an outer layer and forming a top of the container. The inner layer has an inner layer panel and the outer layer has a sealing panel. The sealing panel completely covers the inner layer panel. At least one strip is integrally formed from the material which comprises the outer layer and connects the sealing panel to a remaining portion of the outer layer. The inner layer panel and the sealing panel are permanently joined to each other to provide an access opening into the container. Releasable adhesive is provided around a perimeter of the sealing panel for adhering the sealing panel to the inner panel. The sealing panel is releasable from the inner layer by pulling back the sealing panel in a peeling direction and resealable against the top to seal the opening when the sealing panel is moved back against the top.

Advantageously, after the structure breaks, one or both residual ends of the broken structure are rippled or curved upward from the top of the container.

The present invention, in one form, relates to a package integrity feature comprising a structure associated with an end portion of a resealable closure of a container. The structure is breakably attached to the end portion on one end of the structure and permanently attached to a remainder of the container at a second end of the structure, wherein the breakable structure is constructed such that it can be grasped from below with one's fingers and broken to thereby break its connection between the tab portion and the remainder of the container, thereby leaving the end portion free of its attachment to the container through the structure.

In various further specific forms, the structure comprises a strip extending between a tab portion of the closure, which comprises the end portion of the closure, and an adjacent portion of the container, and the strip includes a weakened portion. Further, advantageously, the structure is preferably raised from a top surface of the container which allows one to easily grasp the breakable structure from below with one's fingers.

The present invention, in yet another form thereof, relates to a package integrity indicating feature comprising a film layer forming a top of the container and having a flap defining an access opening to gain access to the contents of the container. A sealing panel completely covers the flap of the film layer. The sealing layer comprises a pull tab with a strip which is permanently affixed to the top. The pull tab and the strip define a gap between the top of the container and the pull tab and strip. A releasable adhesive is provided on either or both the sealing panel or the film layer adhering the sealing panel to the film layer. The sealing panel is releasable from the film layer, after the strip joining the sealing panel to a portion of the top has been broken, by pulling the sealing panel back in a peeling direction and is reclosable against the top to seal the access opening when the sealing panel is moved back against the top.

The present invention, in another form thereof, concerns a package integrity indicating feature comprising a structure associated with an end portion of a resealable closure of a container. Both the end portion and the structure are non-adhered to an adjacent top surface of the container. The structure is breakably attached to the end portion and permanently attached to a remainder of the container, wherein the structure must be separated between the end portion of the resealable closure and the remainder of the container in order to open the resealable closure.

The present invention, in another form thereof, relates to a package integrity indicating feature comprising an at least two-ply material comprising a first film layer adhesively joined to a second film layer. A first tear line is formed in the first film layer defining a first layer panel for providing an access opening through the first film layer when separated from the first film layer along the first tear line. The second film layer has a second layer tear line defining a sealing panel having one end terminating at a breakable structure. The sealing panel completely covers the first layer panel. The second film layer includes a releasable adhesive layer for releasably adhering the sealing panel to the first film layer, wherein the second film layer can be pulled back and separated from the first film layer to expose the access opening and gain access to the contents therein only after the breakable structure is broken. Food items disposed in the container may include, but are not limited to, cookies, crackers, peanuts, cheese, sliced meats and semi-solid foods.

Other features and advantages of the present invention are stated in or apparent from detailed descriptions of the presently preferred embodiments of the invention which follow.

DETAILED DESCRIPTION OF THE PREFERRED EMBODIMENTS

Figure 1:
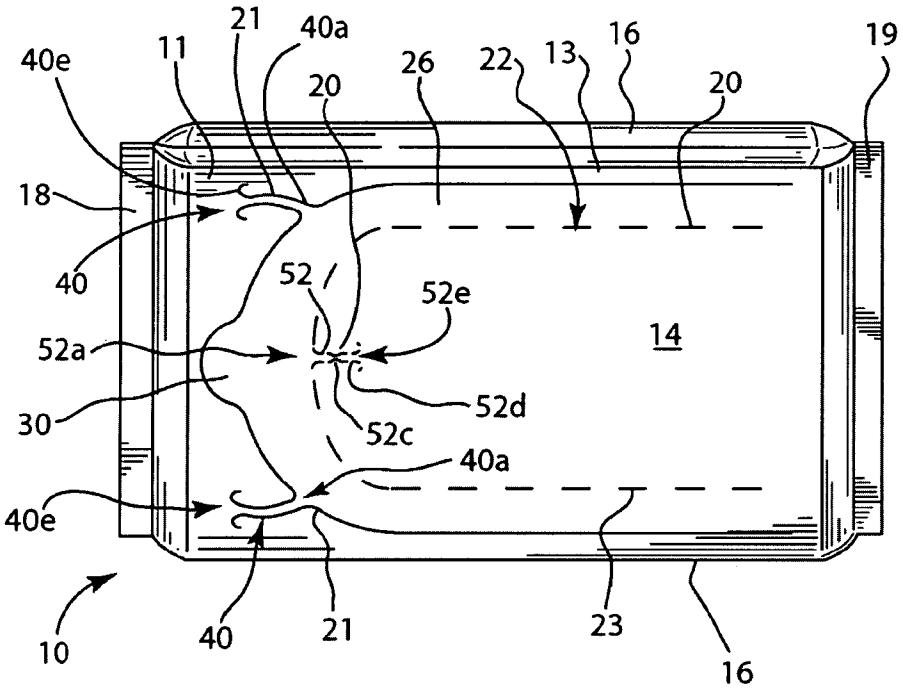
FIG. 1 is a perspective view of a package, including an exemplary closure prior to an initial opening, according to the present invention.

The package integrity feature of the present invention is, in one form, an improvement of the package shown in the '751 application, which, for convenience, is described in further detail therein. The present new package integrity feature can be used to complement the package integrity features of the '751 application, as shown in FIGS. 1-10 and 12-24, or by itself, as shown in FIGS. 11 and 25.

Referring to the figures and, in particular, FIGS. 1-4, there is shown package 10 with closure 11 which incorporates a package integrity feature. Package 10 includes a two-ply wrapper comprising a first, inner film layer 12 and a second, outer film layer 13 forming a top or upper surface 14, sides 16, lower surface (not shown), and crimped ends 18, 19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items 58 such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of the package 10, the inner film layer 12 is die cut on its side via tear line 20, which includes all of the dashed lines in FIG. 1. The outer film layer 13 is die cut on its side via a second layer tear line 21. The creation of tear lines 20, 21 are disclosed in U.S. Patent Application Serial No. 2005/0276525, herein incorporated by reference.

Tear line 20 is formed as a continuous tear line to define inner panel 22. Tear line 20 also defines strip 52. Tear line 21 defines sealing panel 26 of the outer film layer 13 and package integrity structure 40. Advantageously, package 10 includes a pair of package integrity structures 40, one on opposite sides of pull tab 30. It is preferable to have an even number of structures 40 with an equal number on opposite sides of the sealing panel 26. Although the figures show two structures 40, any even number is preferable when opening closure 11 for a first time, as described below.

The sealing panel 26 extends beyond the periphery of the tear line 20 so that the sealing panel 26 completely covers and extends beyond the perimeter of the inner panel 22 and strip 52. As a result, the sealing panel 26 completely covers the inner panel 22 and strip 52.

The package integrity structure 40 of the present invention comprises a curved elongated portion extending from a remaining portion of the sealing panel 26 at 40*a* and terminates at a structure end 40*e* in the shape of parallel "U's," defined by die cut 21, which helps ensure that the outer film layer 13 will not tear proximate the end 40*e* and ensures end 40*e* will remain permanently and integrally part of the outer film layer 13 when a user opens package 10, closure 11 for a first time. Structure 40 is integrally formed with the sealing panel 26 and a remainder of the outer film layer 13, due to die cut 21 forming structure 40 from the outer film layer 13.

The outer film layer 13 is adhesively joined to the inner film layer 12. The inner panel 22 can be separated from the remainder of the inner film layer 12 to expose opening 24, whereby access to the contents 58 of the package 10 may be gained. As the inner panel 22 is withdrawn, as shown in the '751 application, structures 40 will initially stretch due to the elasticity of the material which comprises the outer film layer 13. As structures 40 stretch, their length will increase and their width will narrow. Eventually, the structures 40 will be stretched beyond their limits and snap or break, forming complementary broken ends 40*c* and define the resulting broken structures portions 40*b*, 40*d*. Due to the material of outer film layer 13, the resulting structures 40*b*, 40*d* will have a random or variable shape and form. Further, the structure 40 can break at any portion along the length of structure 40; however, typically, structure 40 will break somewhere near the middle between the sealing panel 26 and the remaining portion of the top 14, i.e. between end 40*a* and end 40*e*. Regardless of where along the length of structure 40 the break occurs, the resulting portions 40*b*, 40*d* will be rippled and/or curved upward from the remainder of the package 10 (FIG. 2).

A benefit of having an equal number of structures 40 on either side of tab 30, ensures that an even, approximately balanced force can be applied to sealing panel 26 when pulling back sealing panel 26 for a first time to break structures 40. If there were an unequal number of structures 40 on either side of tab 30, more force would have to be applied to the side having more structures 40.

Figure 2:
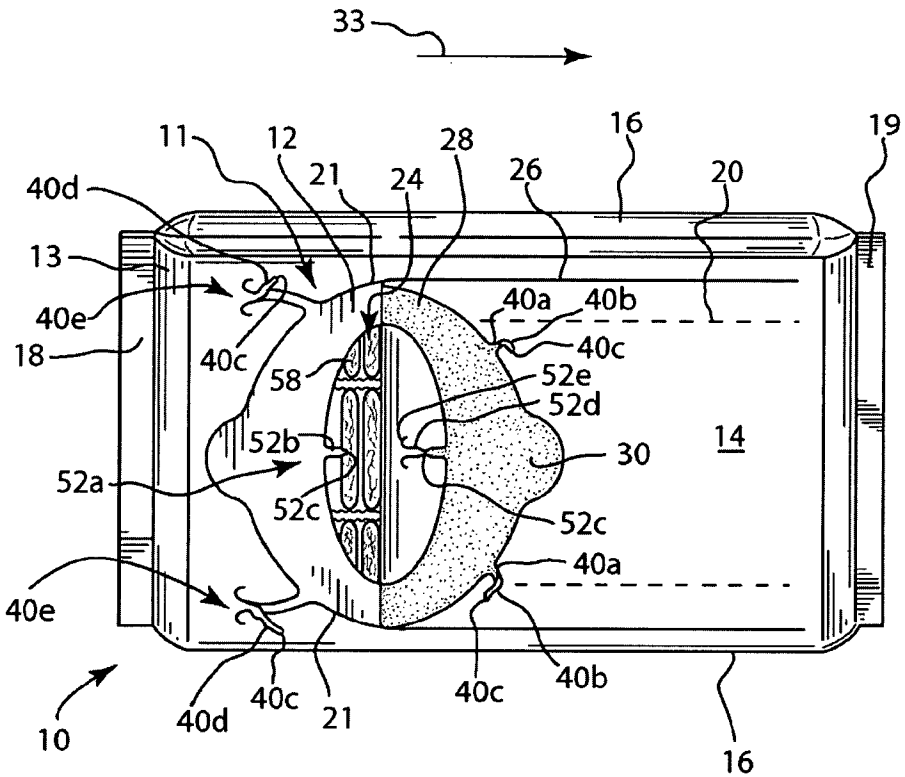
FIG. 2 shows the package of FIG. 1 in a partially opened condition.
Figure 3:
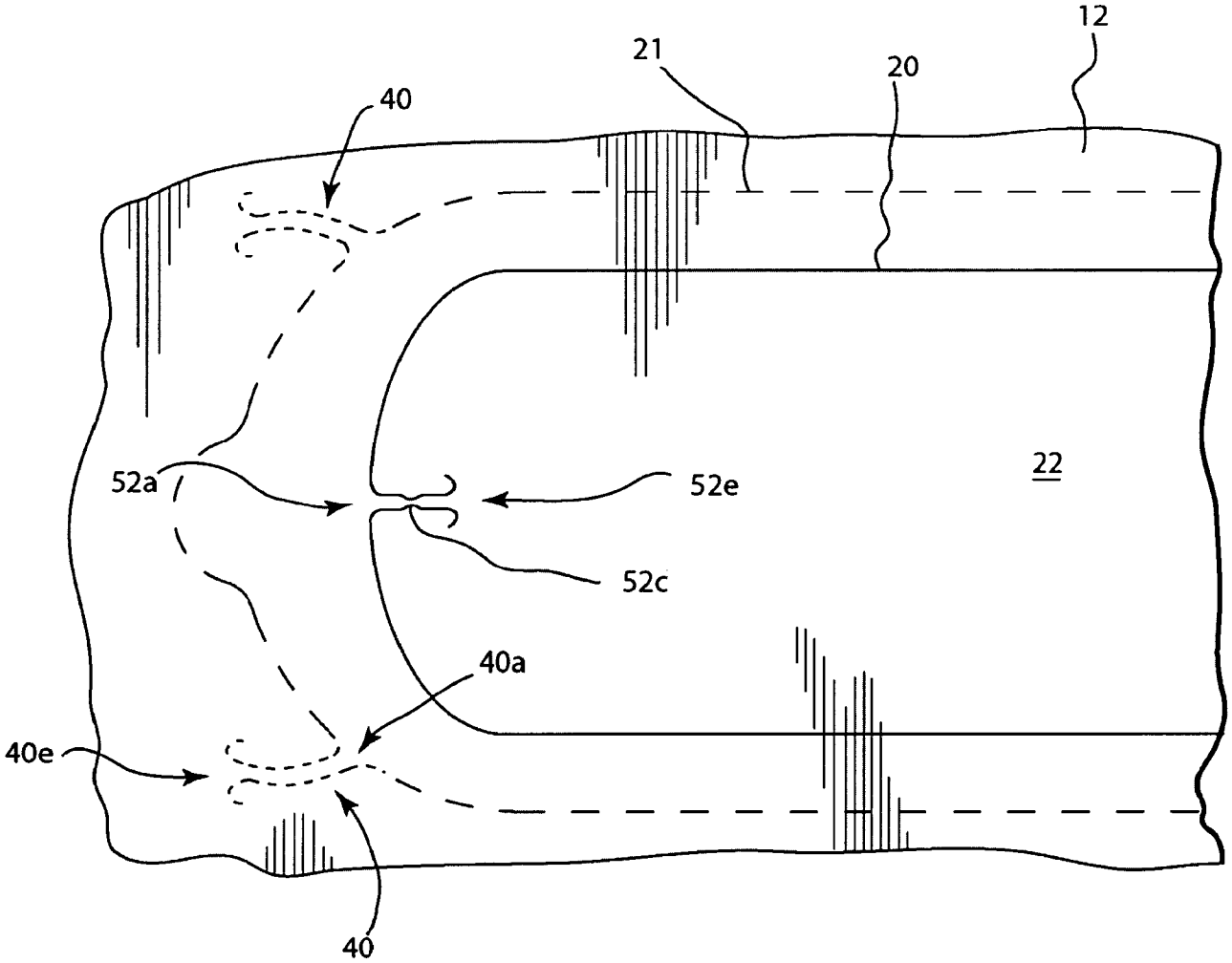
FIG. 3 is a partial plan view of the closure of FIG. 1, as viewed from below, in its initial condition prior to being opened for a first time.

Further, as the inner panel 22 is withdrawn, as shown in the '751 application, strip 52 will break, as shown in FIG. 2. Strip 52 is integrally formed and remains attached to the remaining portion of the inner film layer 12 which comprises the top 14 at strip portions 50*a*, respectively. An end portion 52*d* remains integrally attached to the first panel 22 and end portion 52*b* remains integrally attached to the inner film layer 12. Strip 52 has a weakened portion defined by a narrowing of the width of the strip at portion 52*c*. Advantageously, the die cut of tear line 20 forms the strip end 52*e* in the shape of parallel "U's" which help ensure that strip 52 will not tear at end 52*e* and will remain integrally joined to the inner panel 22 and allow the strip 52 to break at the weakened narrow strip portion 52.

The side of the sealing panel 26 which faces the inner film layer 12 is coated with a resealable adhesive 28 (see FIG. 2), so that the sealing panel 26 may be resealably secured to the inner film layer 12 at the portion adjacent the inner panel 22. The sealing panel 26 includes the tab 30 or other pullable feature which is not coated with adhesive 28 so that the sealing panel 26 may be peeled back from the inner film layer 12 to open the package 10.

Alternatively, or along with releasable adhesive 28, releasable adhesive can be coated on the inner film layer 12 along the outside perimeter of the inner panel 22. The releasable adhesive can be any pressure sensitive adhesive which allows resealing and includes, but is not limited to, the adhesives disclosed in U.S. Pat. No. 7,350,688, herein incorporated by reference.

Referring now specifically to FIG. 1, package 10 is opened by first grasping the tab 30 which allows one to pull the sealing panel 26 back for a first time, resulting in structures 40 and 52 stretching. Structure ends 40*a* and strip portion 52*a* remain integrally attached to the remaining portion of the outer film layer 13 and inner film layer 12, respectively (FIG. 2).

Figure 4:
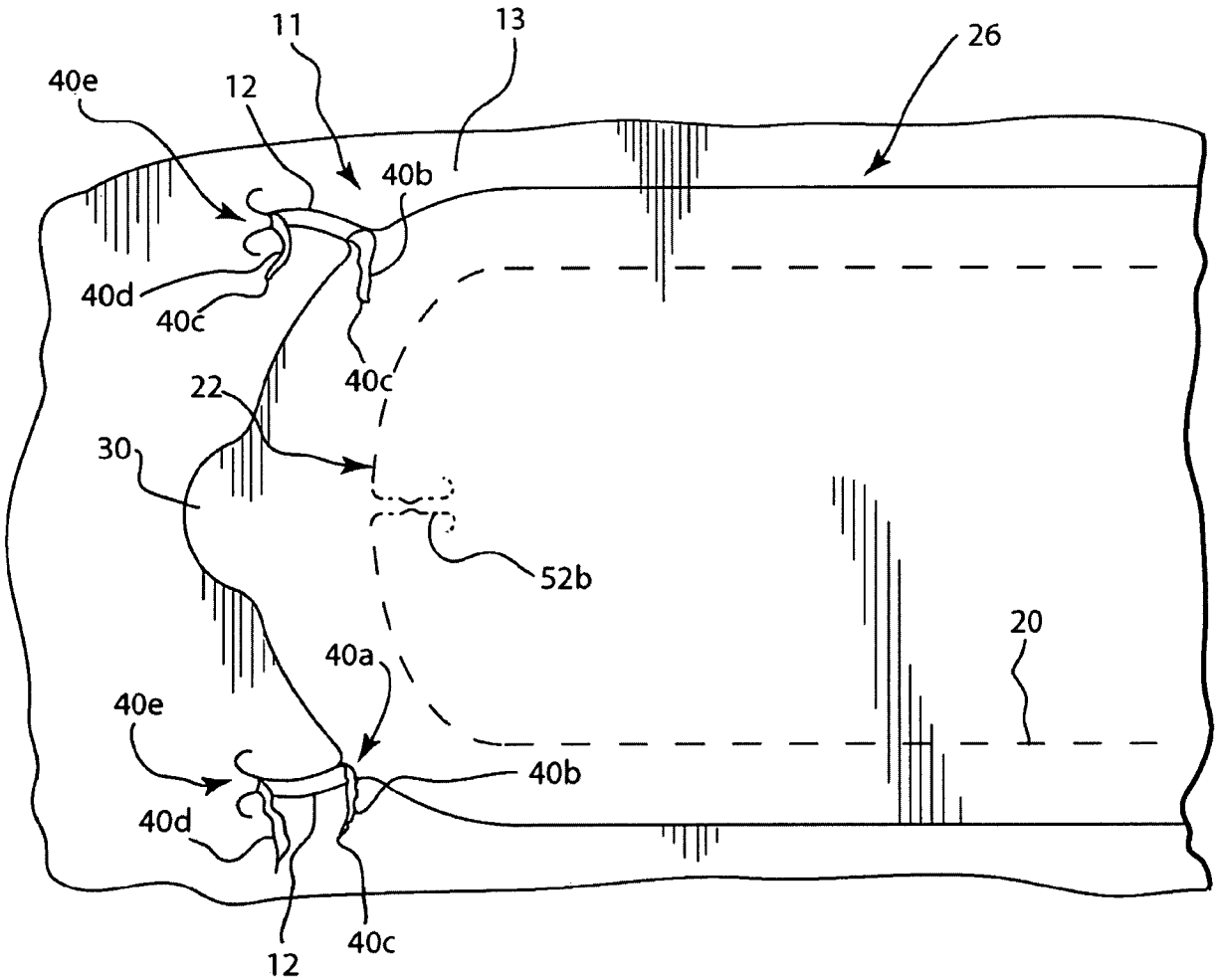
FIG. 4 is a partial plan view of the closure of FIG. 1, after an initial opening and resealing.

Package integrity is indicated by closure 11 through several features incorporated into the closure 11. Initially, package integrity is indicated visually by observing intact package integrity structures 40, as noted. If the closure 11 has been previously opened, structures 40 will no longer be intact and no longer adhere to the top surface of the package 10. In fact, as shown in FIGS. 2 and 4, once closure 11 has been opened for a first time, structure 40 will be broken, resulting in structure portions 40*b*, 40*d* which are rippled, curved and raised from a top surface of the package 10.

Further, package integrity is indicated by observing intact integrally joined strip 52, which advantageously breaks upon opening the closure 11 a sufficient amount prior to allowing one to remove the contents therein. In addition, package integrity is indicated by an audible sound produced when structures 40 and strip 52 break upon opening the package for a first time. Additionally, since the sealing panel 26 does not generally return to its exact position but, instead, is slightly misaligned relative to its original position, package integrity is indicated by misalignment of the sealing panel 26 with the remaining portion of the outer film layer 13 of top 14 (FIG. 4).

Figure 5:
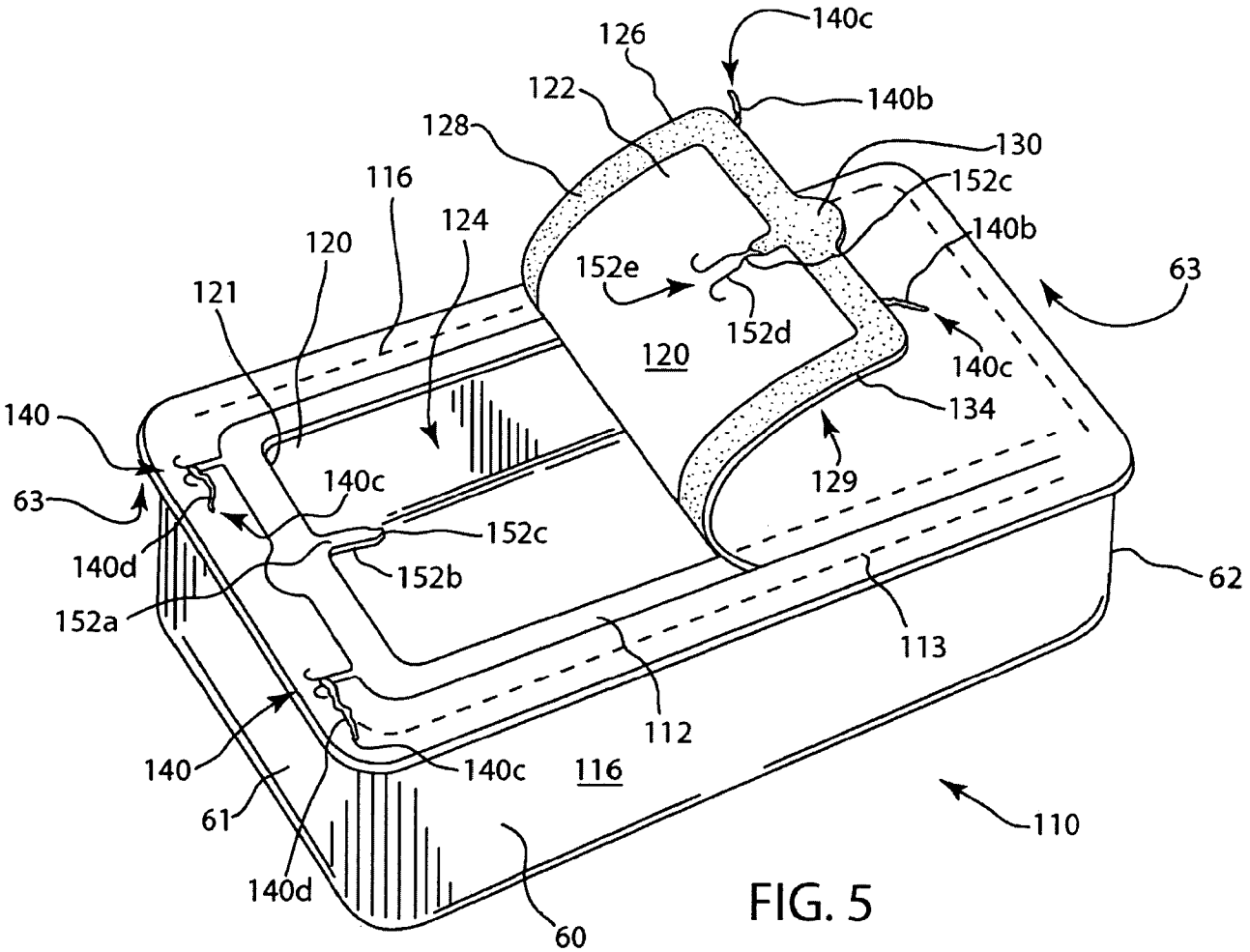
FIG. 5 is a perspective view of another package, in accordance with the present invention, including a closure that has been opened.

Referring to FIG. 5, like elements to those of the embodiment of FIGS. 1-4 are increased by 100. Package 110 comprises a thermal formed tray 60 which forms the sides 116 and ends 61, 62. A two-ply film material comprising an inner film layer 112 and an outer film layer 113 are sealed to flange 63 of the thermal formed tray 60. As with package 10, package integrity is indicated by the presence of an intact structures 140 being integrally formed with the sealing panel 126 and a remainder of outer film layer 113, which forms the top of the package 110. Further, as with package 10, pulling back on tab 130 separates the sealing panel 126 from the outer film layer 113 and separates the inner panel 122 from the inner film layer 112 and structures 140 and portions of strip 152. After package 110 has been opened for a first time, the package integrity structures 140 will break at 140*c*, forming portions 140*b*, 140*d*, and strip 152 will break at narrow strip portions 152*c*, providing visual indication of package integrity status which show that the package has previously been opened, as shown in FIG. 5.

Package 110 can be used for various food items, such as cheese, sliced meats and the like. In addition, package 110 can be used for semi-solid items, such as pudding and yogurt. Although package 110 is depicted as having a rectangular shape, the package 110 can have any shape, including cylindrical and irregular.

The inner and outer film layers 112, 113 may be formed of the same material as layers 12, 13, which includes polypropylene, polyethylene, cellophane or any other polymeric material suitable for forming a package enclosure.

Figure 6:
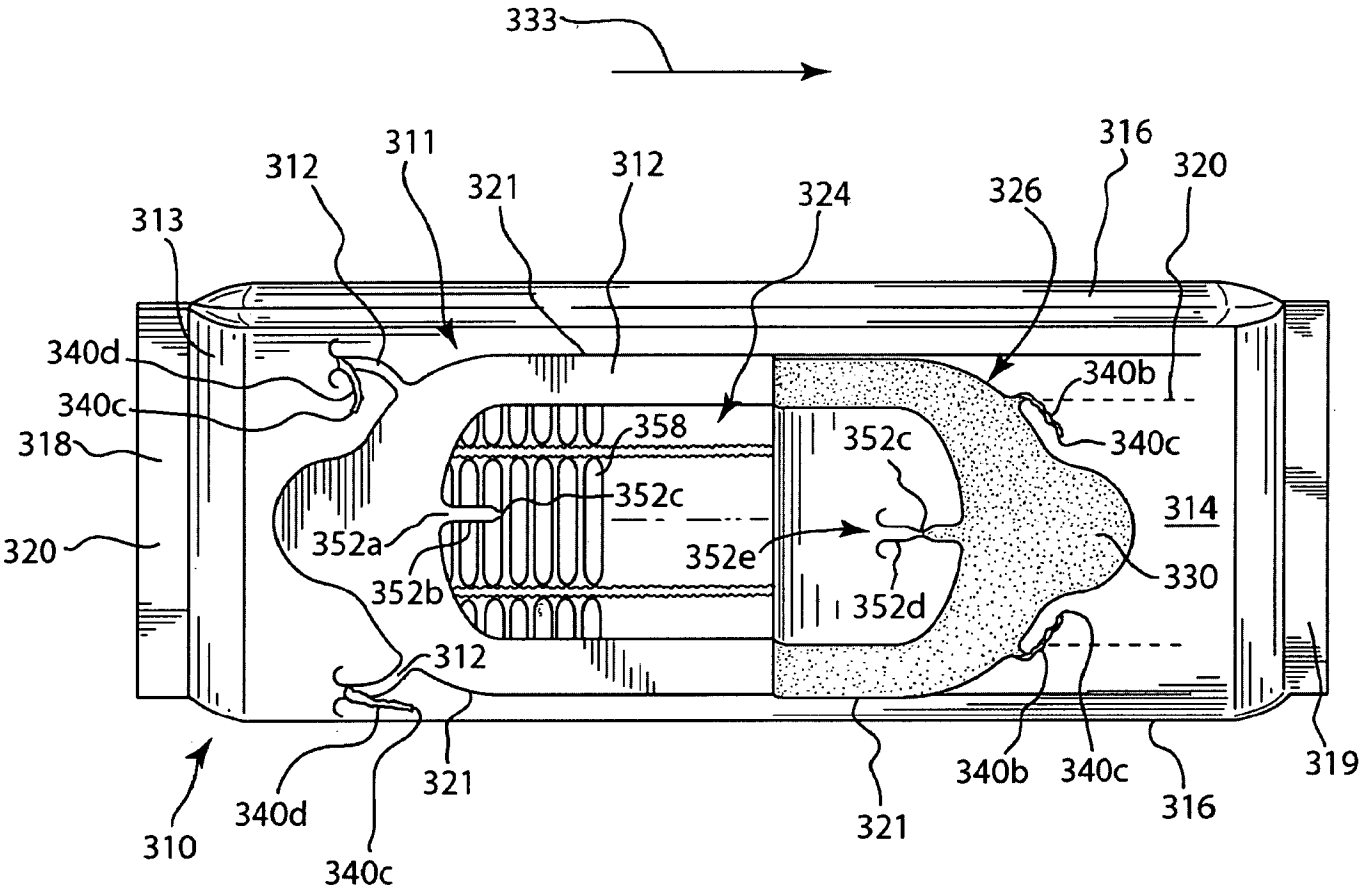
FIG. 6 is a perspective view of another package, in accordance with the present invention, with the package integrity feature, shown in a partially opened condition.
Figure 7:
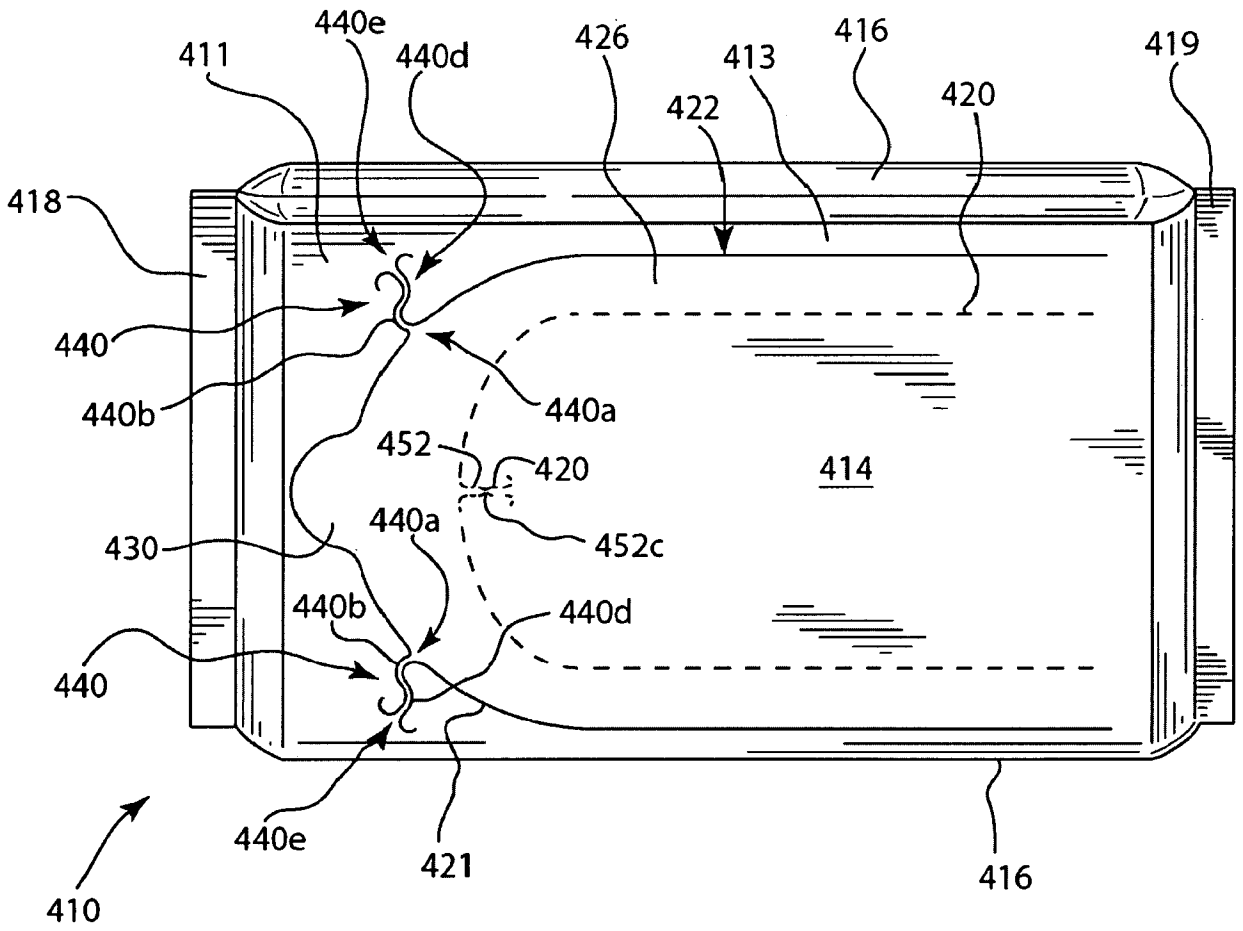
FIG. 7 is a perspective view of another package, in accordance with the present invention, including a closure that has not been opened.

Referring now to FIG. 6, like elements to those of the embodiment of FIGS. 1-4 are increased by 300. Package 310 is designed to accommodate a single row of food items, such as cookies 358. When opening package 310 for a first time, structures 340 will break, separating the sealing panel 326 from the remaining portion of the outer film layer 313, thereby allowing one to pull back sealing panel 326 from the top of the package 310. Package integrity is indicated by broken structures 340, as well as by observing the status of strip 352.

Referring now to FIGS. 7-10, like elements to those of the embodiment of FIGS. 1-4 are increased by 400. Package 410 has a package integrity structure 440 in the shape of a wavy strip, rather than the curved strip 40 of package 10. The wavy shape of structure 440 has a concave segment 440*b* and a convex segment 440*d*. Package 410 indicates package integrity in a similar manner to that of package 10, in that in an initial condition, prior to the sealing panel 426 being peeled back for a first time, package integrity is indicated by observing intact structures 440.

Figure 8:
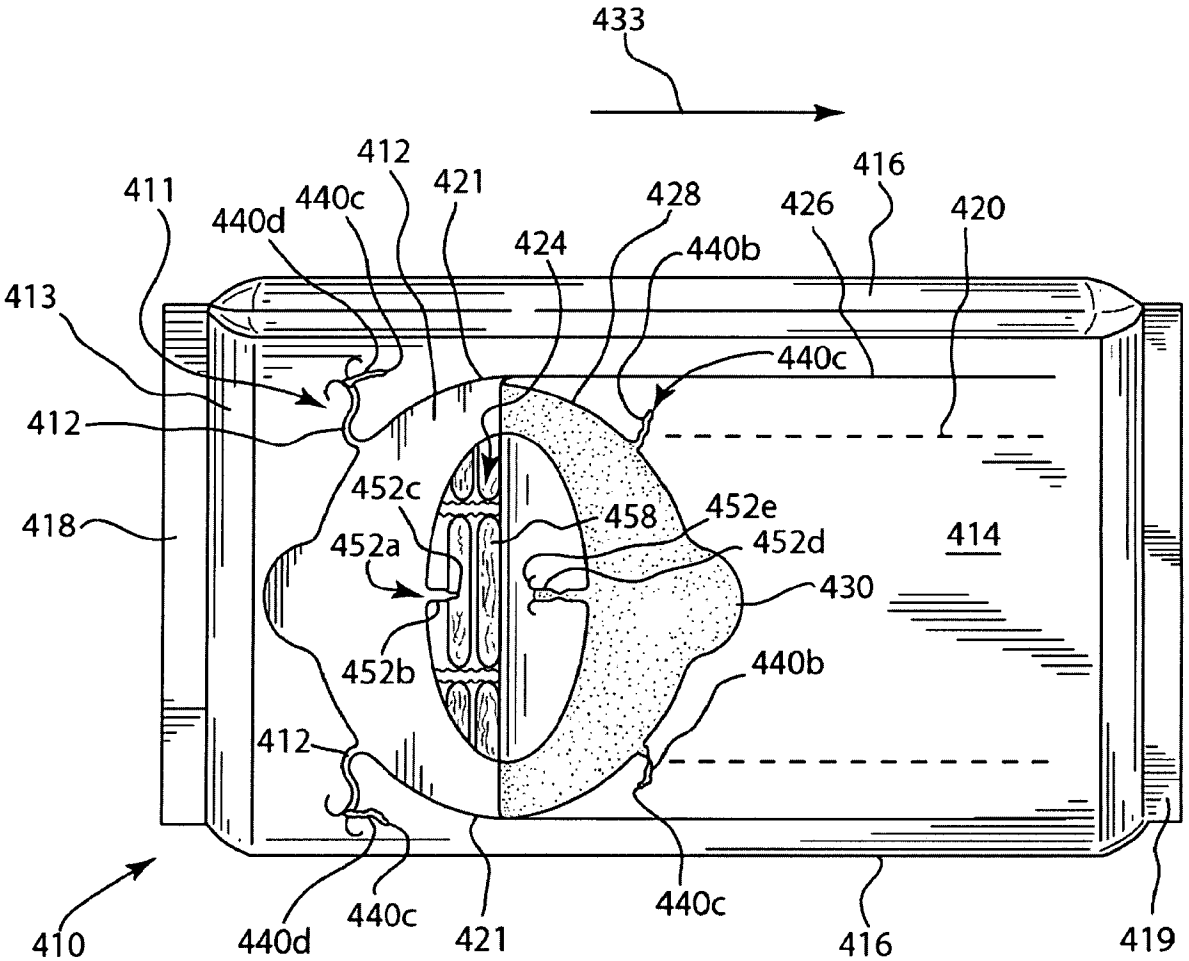
FIG. 8 shows the package of FIG. 7, shown in a partially opened condition.
Figure 9:
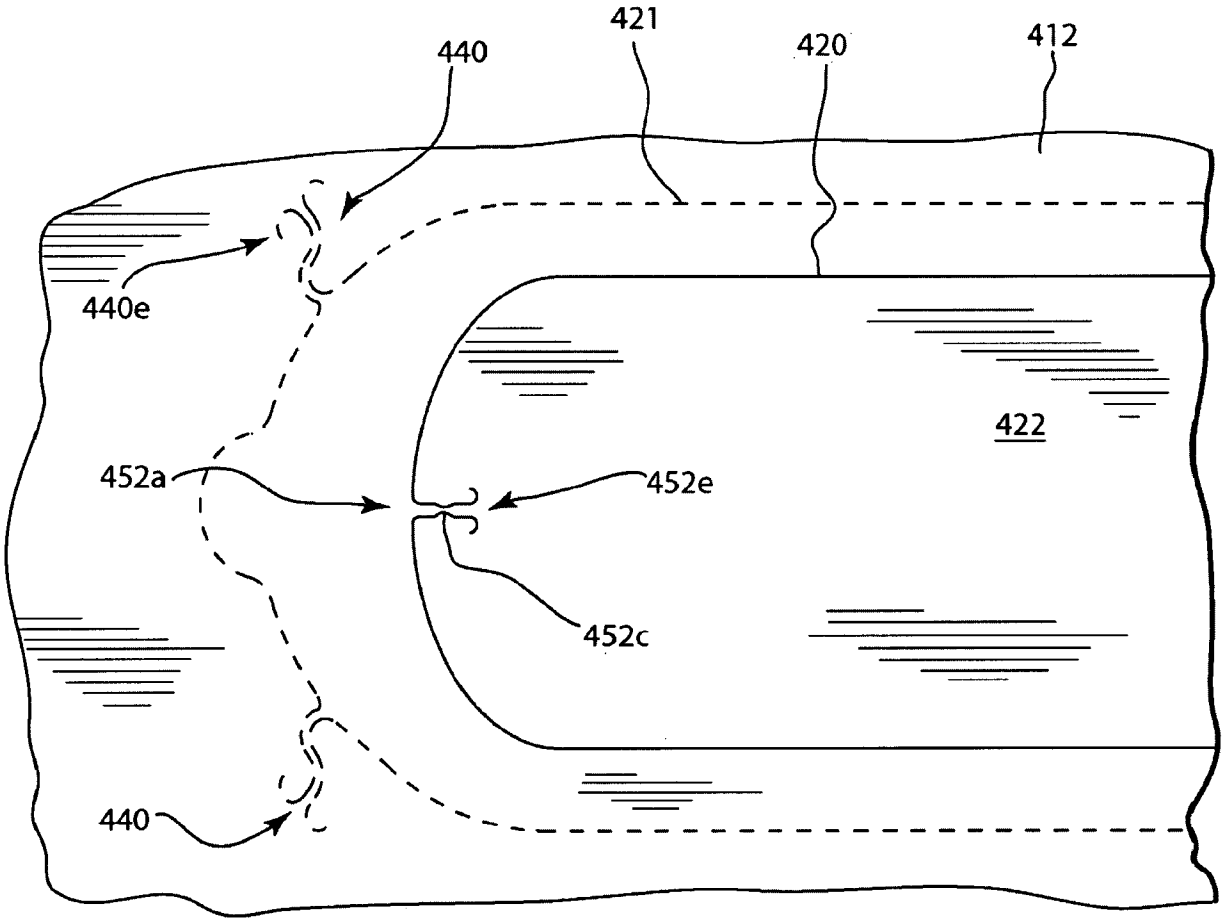
FIG. 9 is a partial plan view of the closure of FIG. 7, as viewed from below, in its initial condition prior to being opened for a first time.
Figure 10:
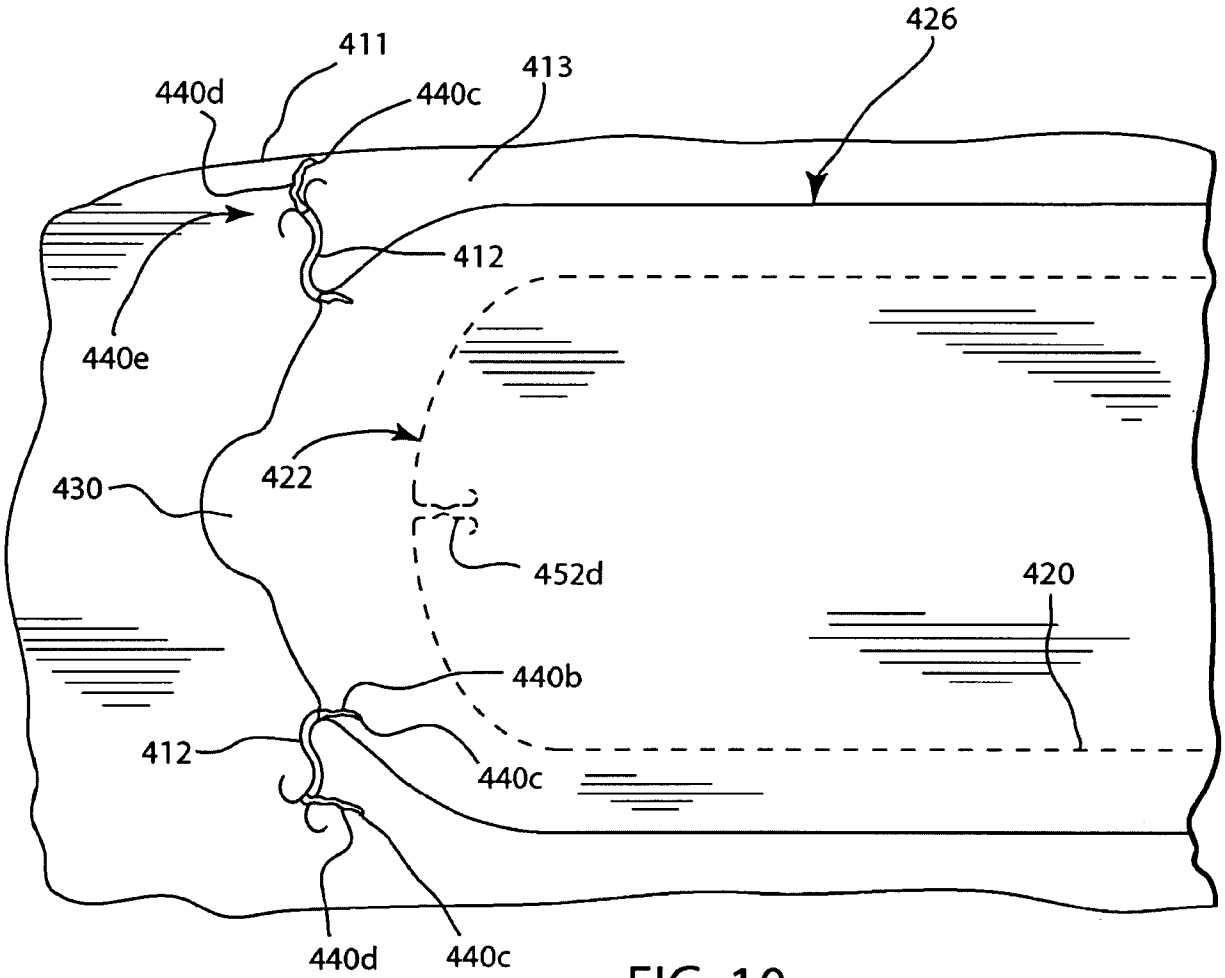
FIG. 10 is a partial plan view of the closure of FIG. 7, after the package has been previously opened and resealed.
Figure 11:
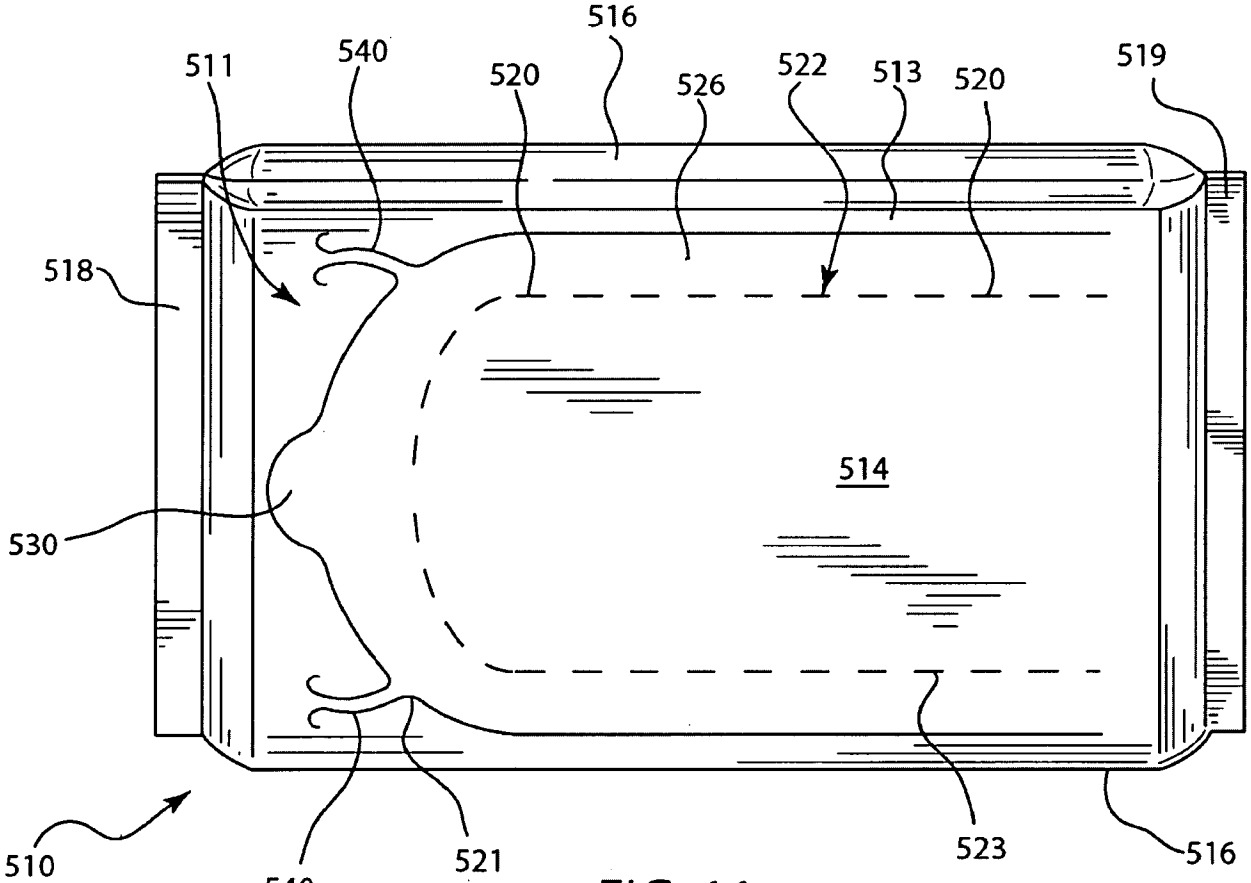
FIG. 11 is a perspective view of another package, prior to an initial opening, in accordance with the present invention.

Upon withdrawing sealing panel 426 for a first time, structures 440 will initially stretch and increase in length, and eventually break, resulting in broken ends 440*c* and segments 440*b* and 440*c* being rippled, curved and/or raised from a top surface of the remaining portion of the top 414 of package 410 (FIGS. 8 and 10). Likewise, as with package 10, withdrawing sealing panel 426 for a first time, first stretches and then eventually breaks strip 452.

As noted above, the package integrity feature of the present invention can be used by itself instead of as a complement to the package integrity feature of the '751 application. FIG. 11 is representative of any package wherein the package integrity feature of the present invention is the sole package integrity feature. Referring now to FIG. 11, like elements to those of the embodiment of FIGS. 1-4 are increased by 500. Package 510 includes package integrity structure 540, which joins sealing panel 526 to the remaining portion of the outer film layer 513, as the sole package integrity feature.

Package integrity is indicated in package 510 by an intact structure 540 attached to sealing panel 526 and a perimeter of the outer film layer 513. A user opens closure 511 by pulling back on tab 530 to withdraw sealing panel 526 from the top of package 510, thereby separating the inner panel 522 from the inner film layer 512 to gain access to the contents contained within package 510. Pulling back on tab 530 for a first time results in structures 540 stretching and eventually breaking, as described above with regard to structures 40 of package 10.

Figure 12:
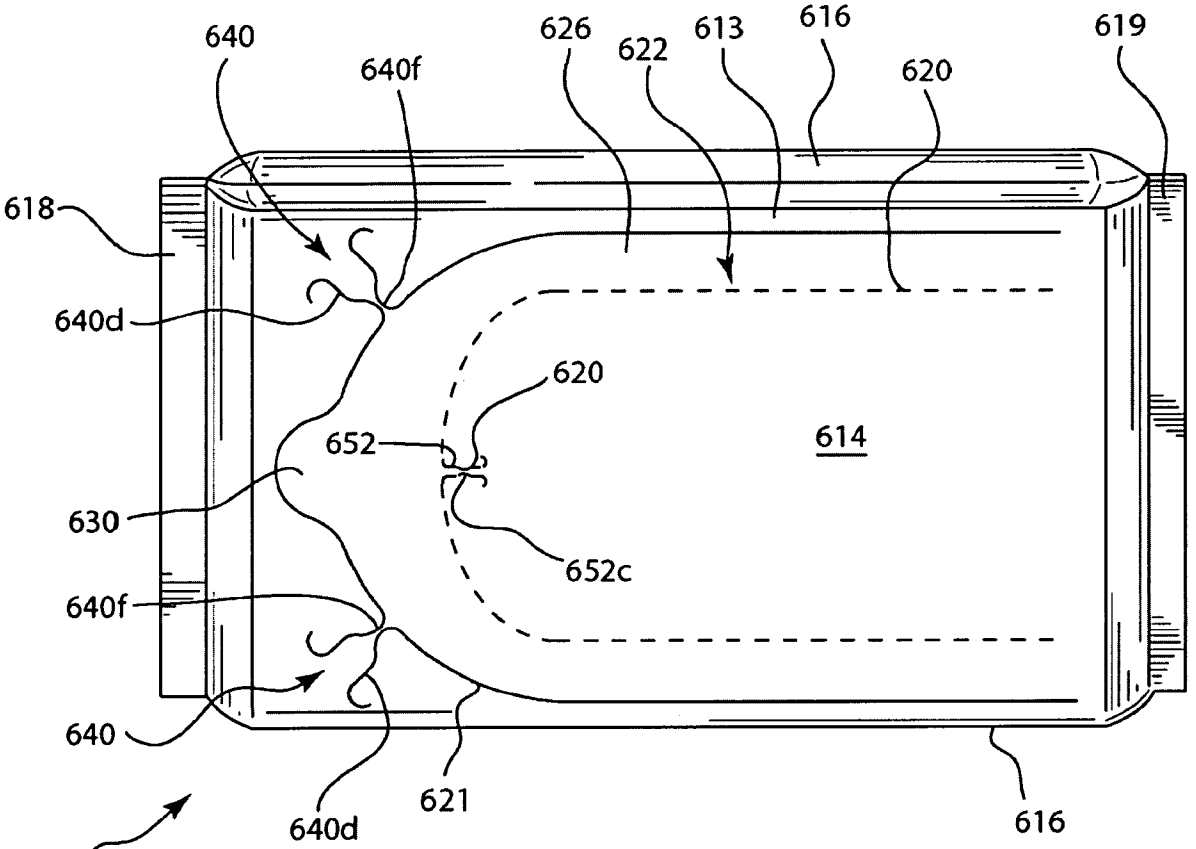
FIG. 12 is a perspective view of another package, including a package integrity feature, shown in its initial unopened condition.
Figure 13A:
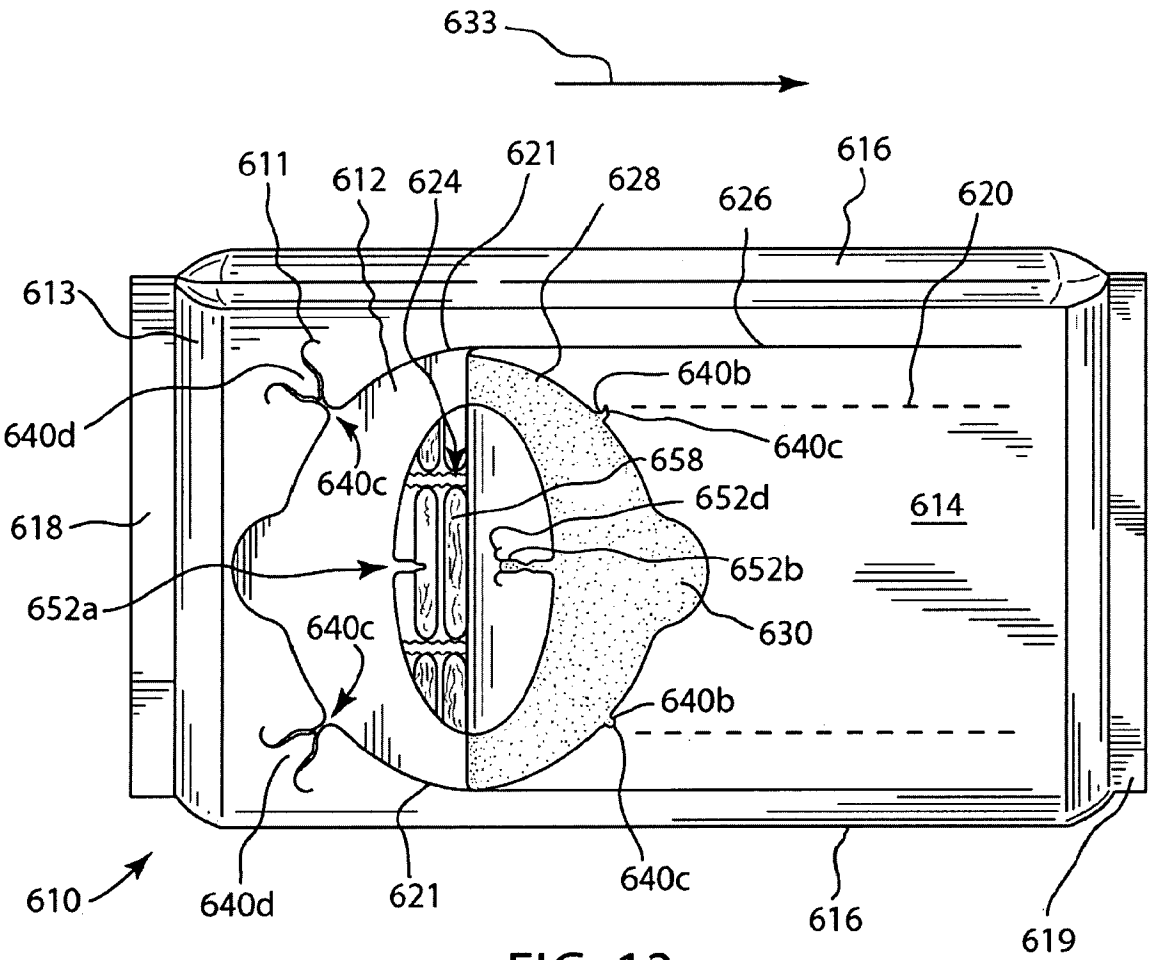
FIG. 13*a* shows the package of FIG. 12 in a partially opened condition.
Figure 13B:
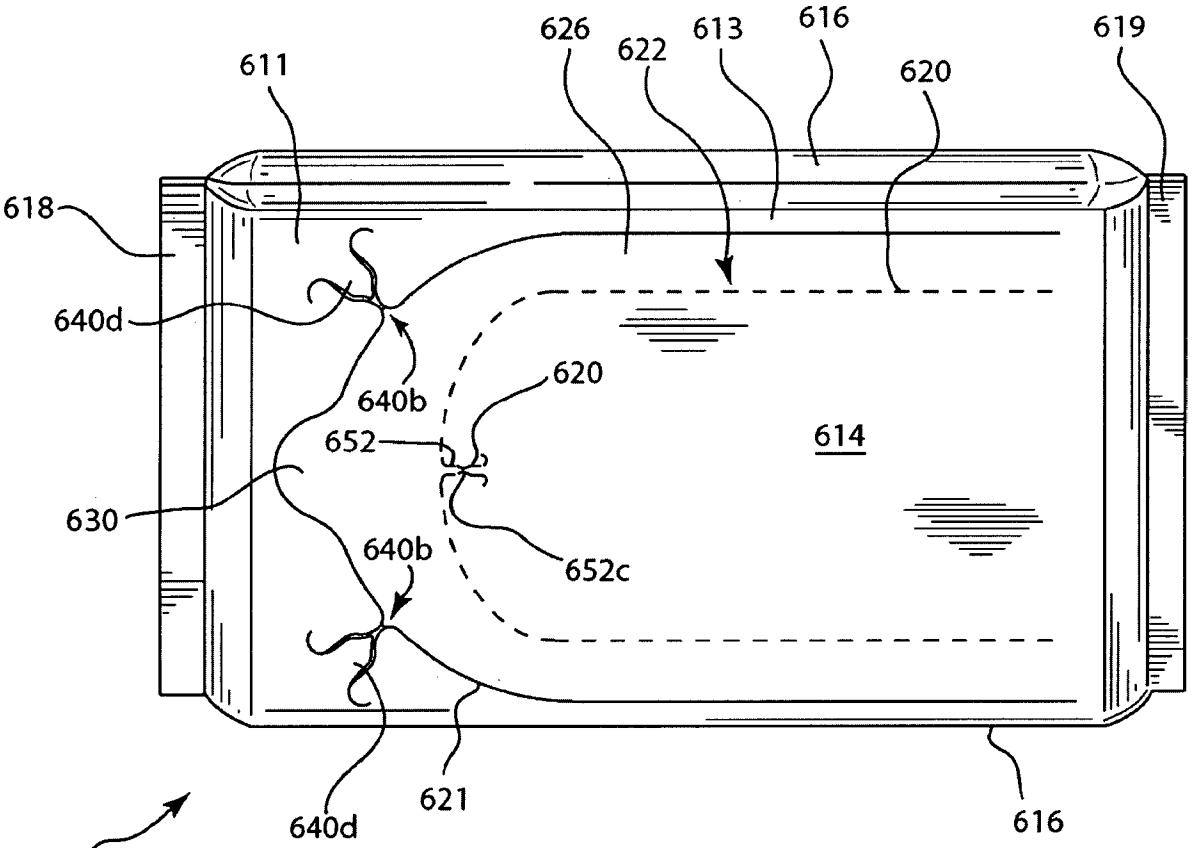
FIG. 13*b* shows the package of FIG. 12, after it has been opened and resealed.

Referring now to FIGS. 12-13*b*, like elements to those of FIGS. 1-4 have been increased by 600. Package 610 is identical to package 10, except that structure 640 has a narrow portion 640*f* connected to a broader band portion 640*d*. When sealing panel 626 is pulled back for a first time, by grasping tab 630, the structure 640 initially stretches and then breaks at the narrow portion 640*f*, resulting in broken ends 640*c* (FIG. 13*a*). Likewise, as in package 10, pulling back sealing panel 626 for a first time results in strip 652 breaking. When the sealing panel 626 is returned flat on the top of the package 610, indication that the package 610 has been previously opened is visible by the broken structures 640, the slight misalignment of portions 640*b*, 640*d* with the remainder of the material forming the outer layer 613, and possible misalignment of the sealing panel 626 with the remainder of the outer layer 613 (FIG. 13*b*). In addition, structures 640*b*, 640*d* may be slightly raised from the top surface 614 of package 610.

Figure 14:
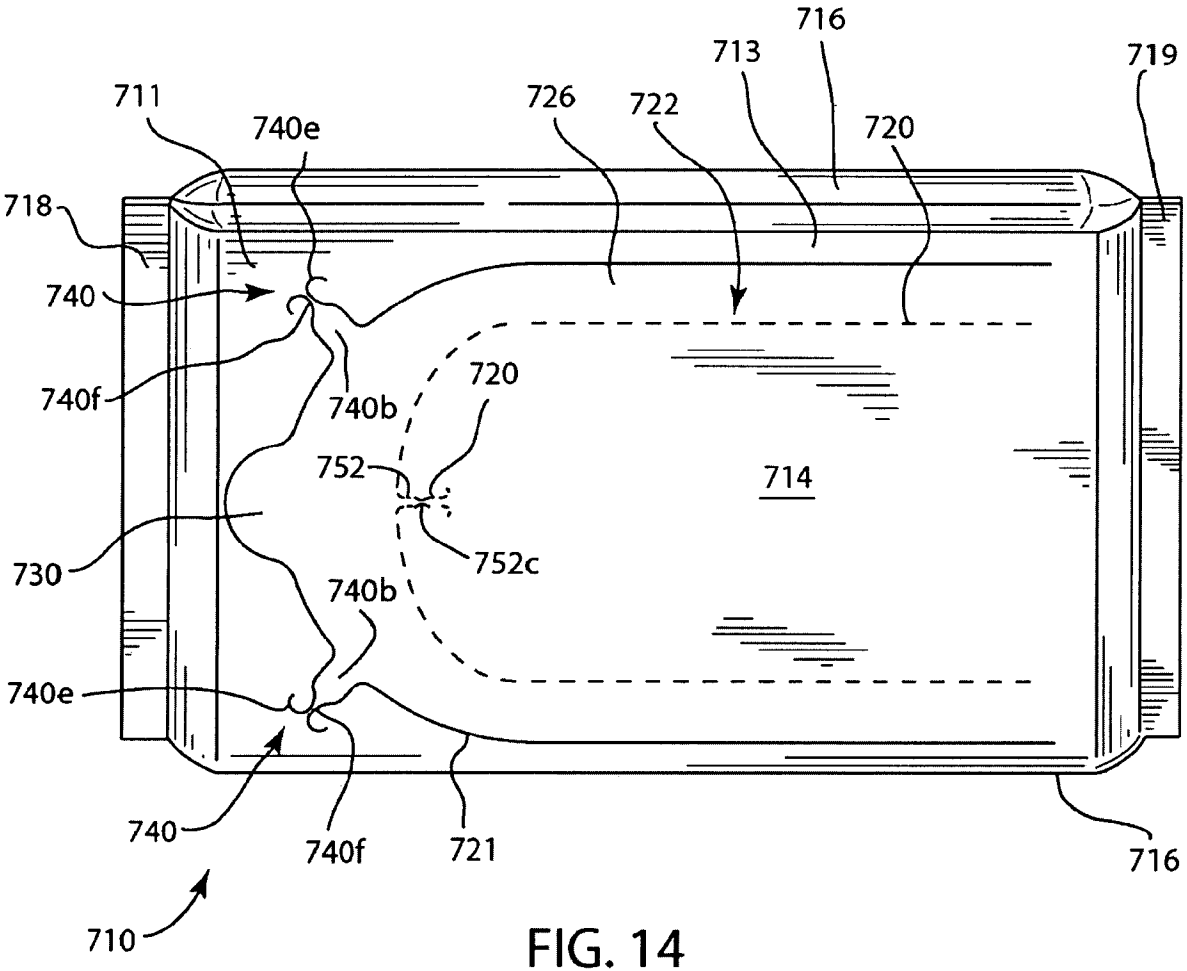
FIG. 14 shows another package, in accordance with the present invention, with package integrity feature shown in its initial unopened condition.
Figure 15A:
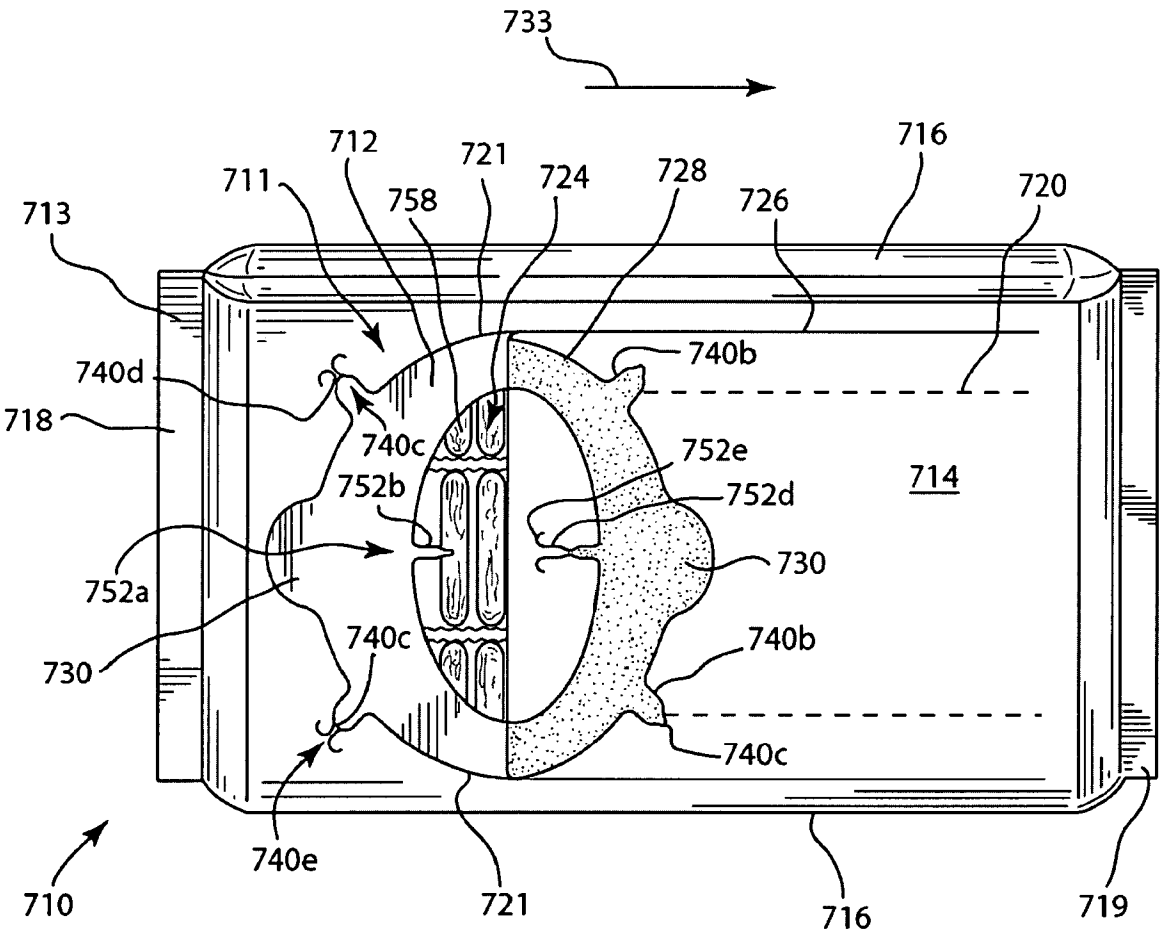
FIG. 15*a* shows the package of FIG. 14 in a partially opened condition.
Figure 15B:
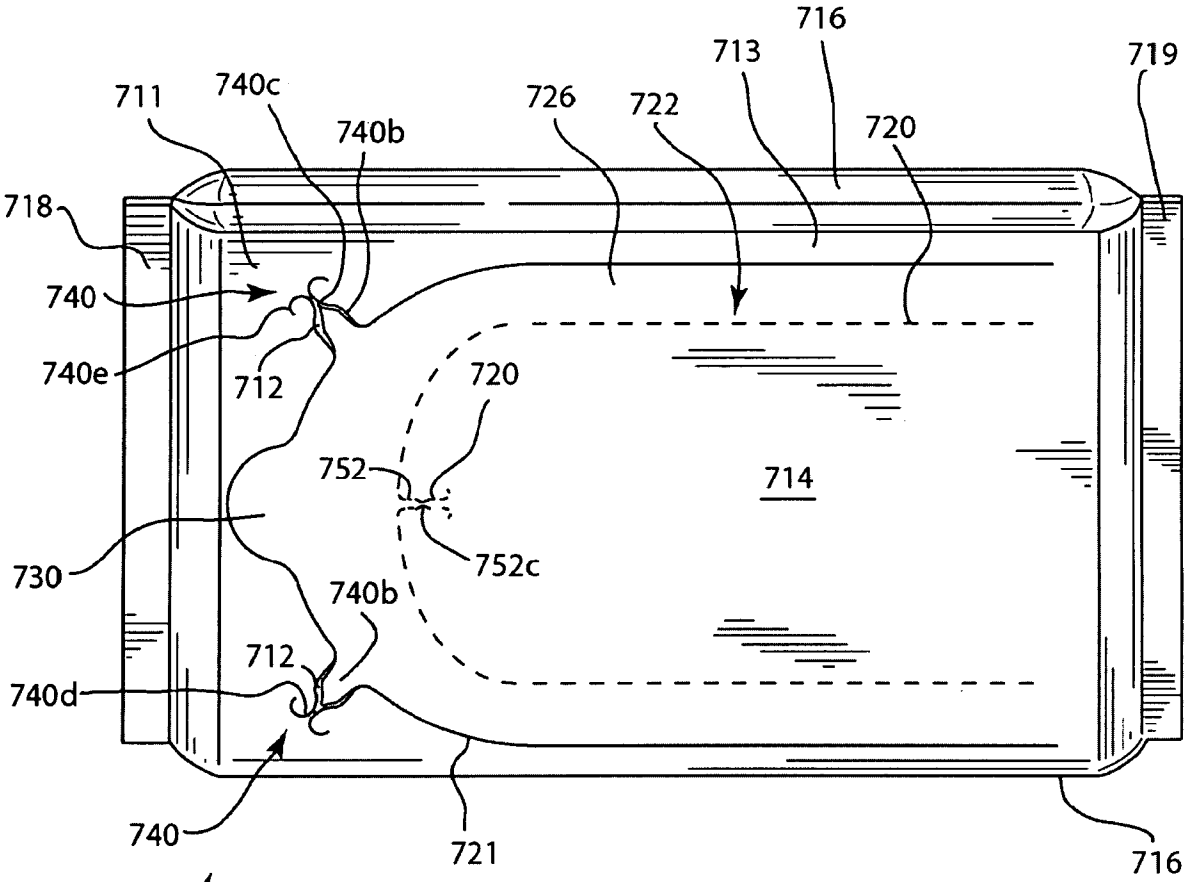
FIG. 15*b* shows the package of FIG. 14, after the package has been opened and resealed.

Referring now to FIGS. 14-15*b*, like elements to those of FIGS. 1-4 are increased by 700. Package 710 is the same as package 610, except the location of the broad band portion 740*b* is located closer to the sealing panel 626, rather than the remaining portion of the top 714 of the container. As a result, when package 710 is opened for a first time, and structure 740 breaks, forming ends 740*c*, the break will be away from the sealing panel 726, relative to that in package 610, resulting in the broader band portion 740*b* remaining attached to the sealing panel 726 (see FIG. 15*a*). Conversely, in package 610, the broader band portion 640*d* remains attached to the remaining portion of the outer layer 613 (see FIG. 13*a*). Package integrity is indicated by broken structures 740, as well as misalignment of portions 740*b*, 740*d* with the remaining portion of the outer layer 713.

Figure 16:
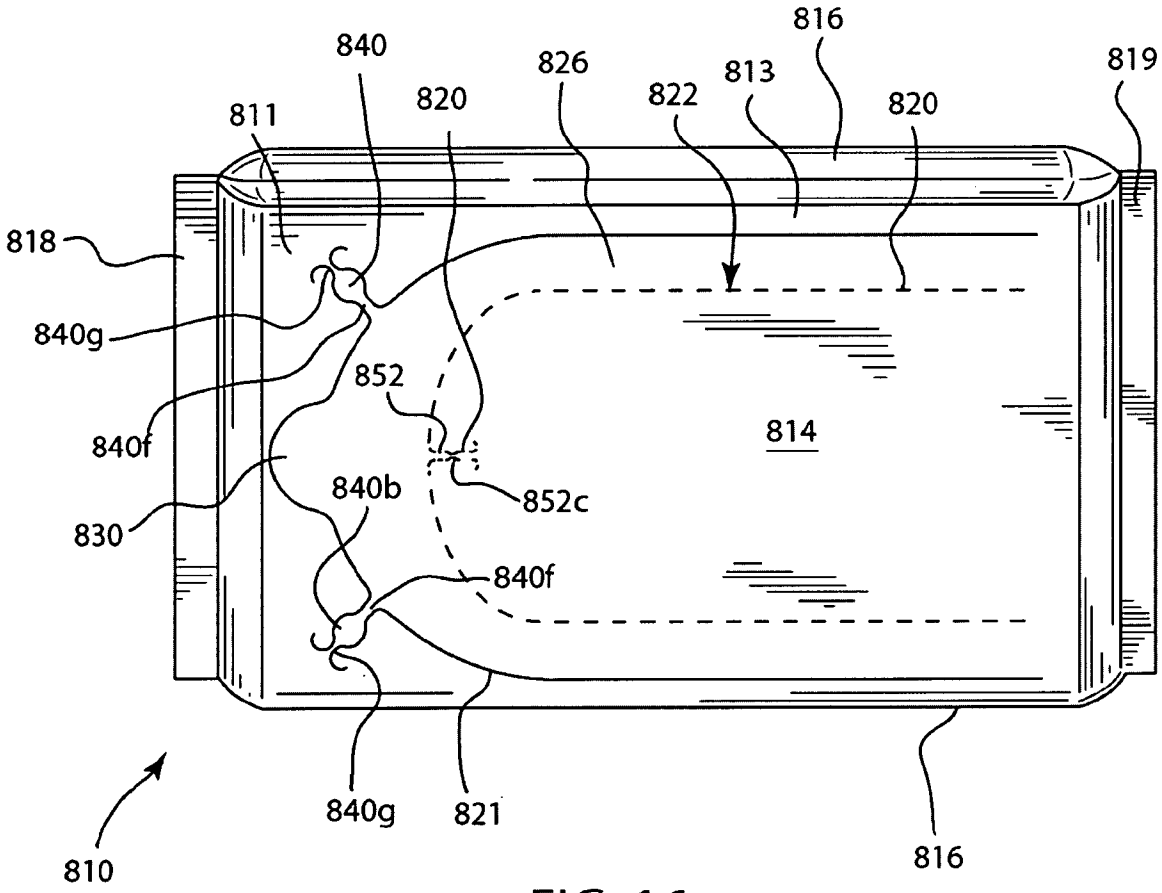
FIG. 16 is a perspective view of another package according to the present invention, in its initial unopened condition.
Figure 17:
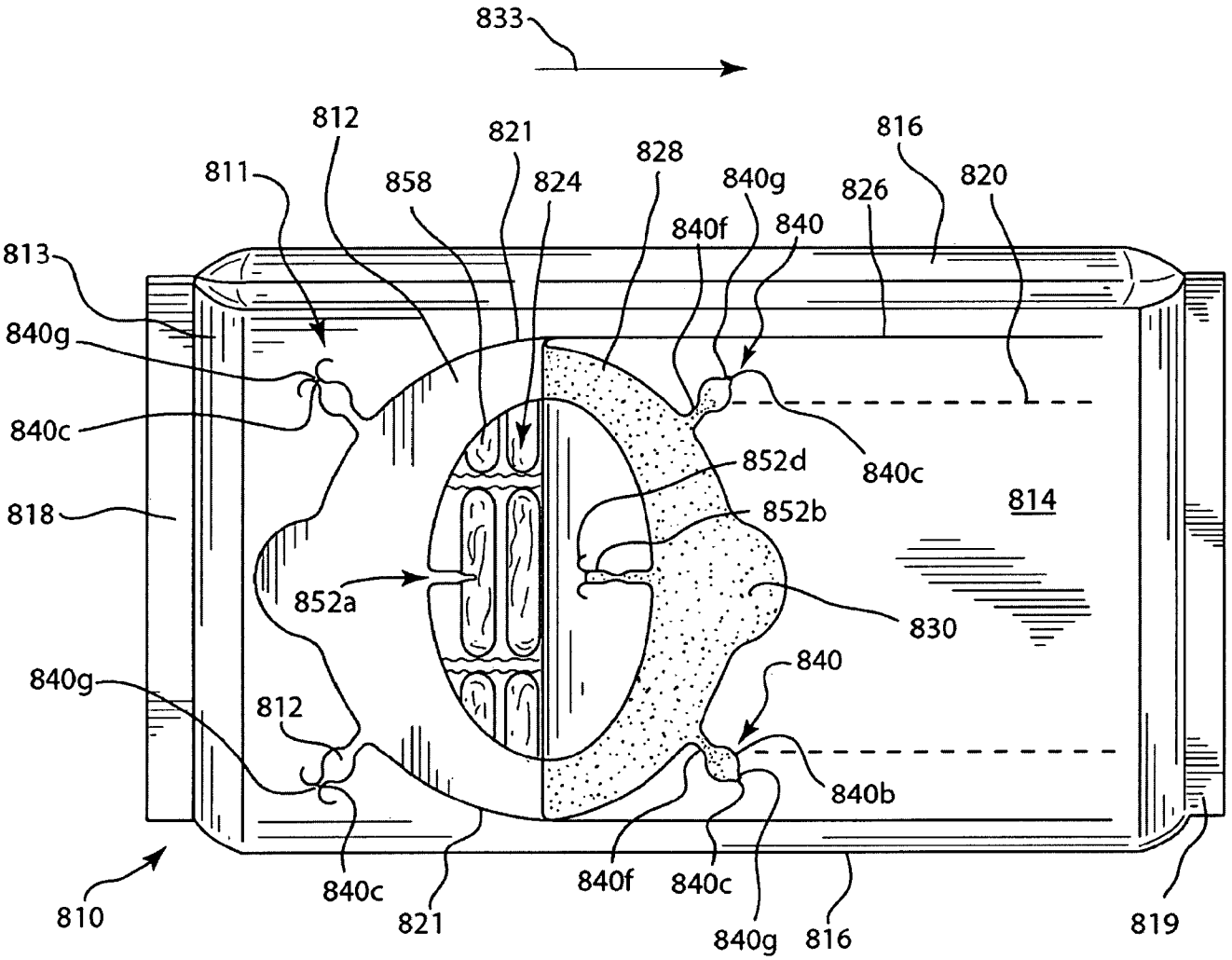
FIG. 17 shows the package of FIG. 16 in a partially opened condition.

Referring now to FIGS. 16 and 17, like elements to those of FIGS. 1-4 are increased by 800. Package 810 is identical to package 10, except that structure 840 comprises two narrow portions 840*f* and 840*g* with a wider section 840*b* in the middle. When the sealing panel 826 is pulled back for a first time, the structure 840 will break at either portion 840*f* or 840*g*. For example, as shown in FIG. 17, the structure 840 is shown broken at portions 840*g*.

Referring now to FIGS. 18-21*b*, like elements to those of FIGS. 1-4 are increased by 900. Package 910 has a package integrity feature structure 940, which integrally attaches sealing panel 926 to the remaining portion of the outer layer 913 at tab 930. Specifically, the package integrity structure 940 of the present invention comprises a narrow portion of strip 940*f*, which is attached to pull tab 930 on one end and a wider portion 940*b* on its other end, which is permanently attached to the remainder of the package. The structure 940 is integrally formed with the pull tab 930 of the sealing panel 926 and a remainder of the outer film layer 913 due to die cut 921 forming structure 940 from the outer film layer 913. The die cut 921 forms the structure end 940*e* in the shape of parallel "U"'s, which help ensure that the outer film layer 913 will not tear proximate the end 940*e* and that portion 940*b* will remain permanently and integrally part of the outer film layer 913 when a user breaks the structure 940 prior to opening the closure 911 for a first time.

Advantageously, structure 940, along with pull tab 930, are raised from a remainder of the upper surface 914 which is formed by outer film layer 913, defining gap 942 between the inner film layer 912, the structure 940 and pull tab 930. The raised structure 940 enables one to easily grasp structure 940 from below withone's fingers and break or separate structure 940 from the pull tab 930. Alternatively, the structure 940 may lie essentially flat, but with no adhesive between it and the top surface of the package. As a result, one may, by slightly pushing in the package at that point, still grasp the structure 940 from below.

Die cuts 25 define a plurality of tab portions 27 in the sealing panel 926 which comprise one of the package integrity features of the '751 application. The sealing panel 926 extends beyond the periphery of the tear line 920 so that the sealing panel 926 completely covers and extends beyond the perimeters of the inner panel 922 and strips 50, 952, 54. As a result, the sealing panel 926 completely covers the inner panel 922 and strips 50, 952, 54.

Figure 19A:
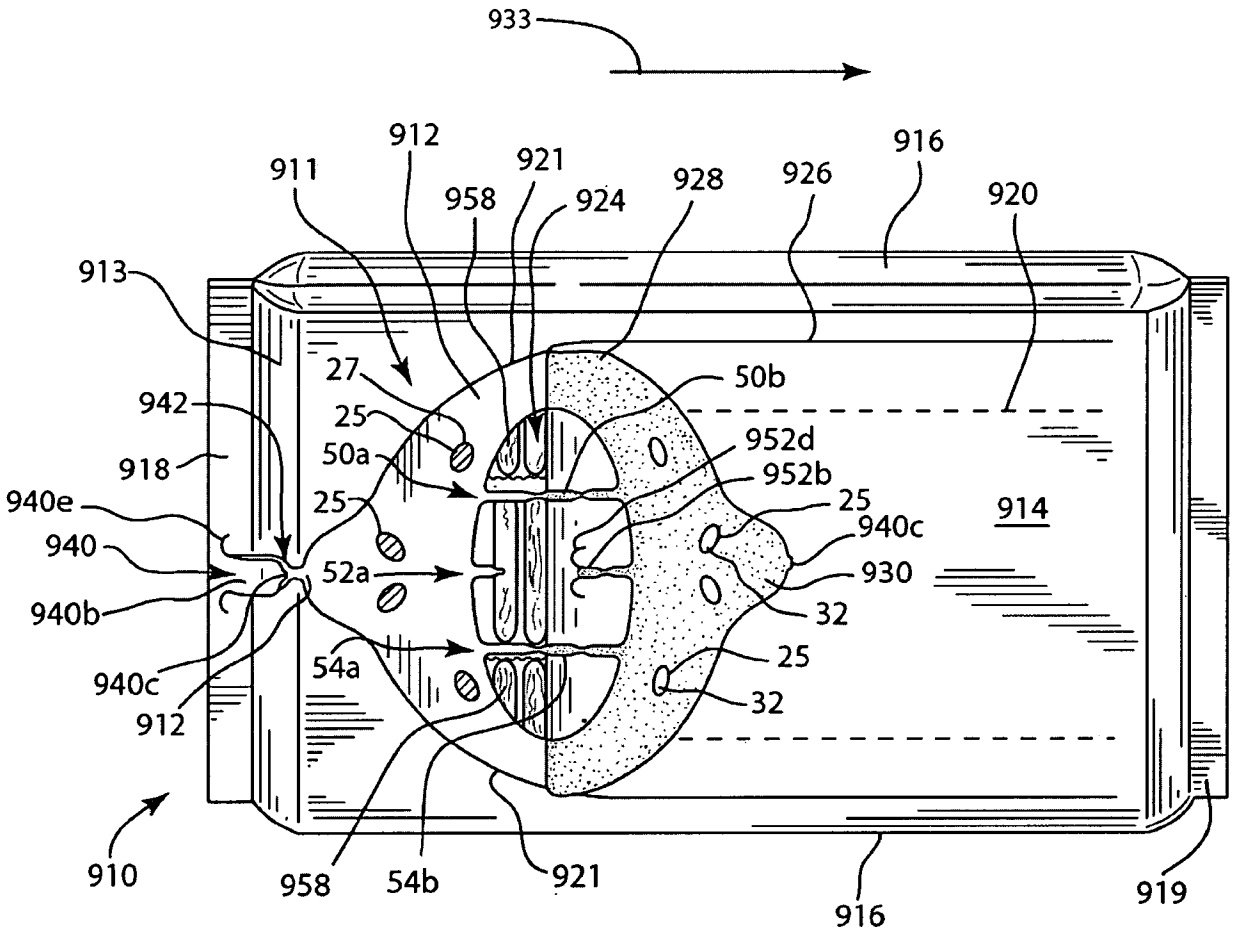
FIG. 19*a* shows the package of FIG. 18 in a first partially opened condition.
Figure 19B:
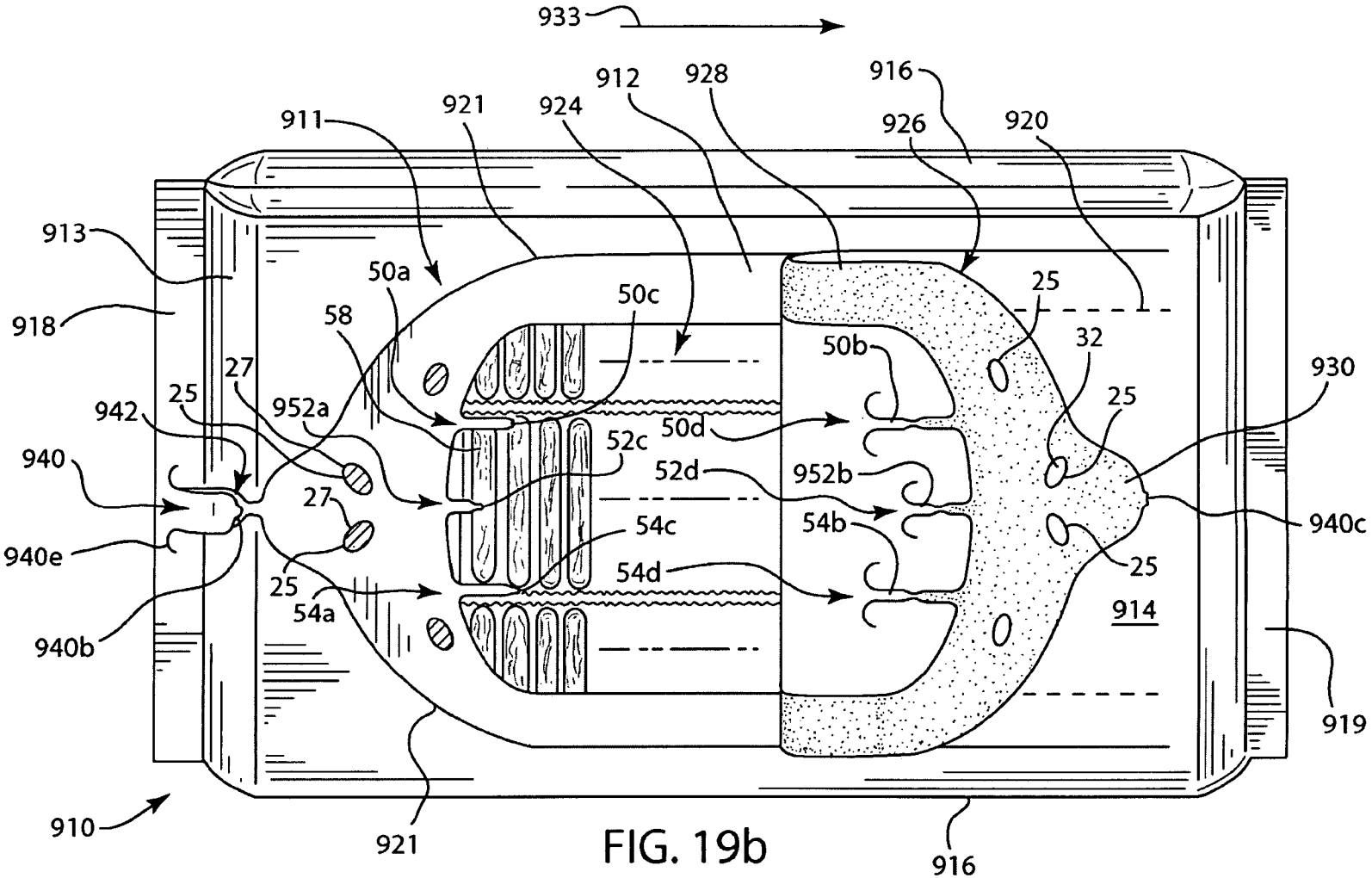
FIG. 19*b* shows the package of FIG. 18 in a further partially opened condition.

The outer film layer 913 is adhesively joined to the inner film layer 912. After the breakable structure 940 has been broken, as discussed in detail below, the inner panel 922 can be separated from the remainder of the inner film layer 912 to expose an opening 924, whereby access to the contents of the package 910 may be gained. As the inner panel 922 is withdrawn, and as shown in the '751 application, strips 50, 952, 54 will break, as shown in FIGS. 19*a* and 19*b*. Each strip 50, 952, 54 is integrally joined and remains attached to the remaining portion of the inner film layer 912 which comprises the top 914 at strip portions 50*a*, 952*a* and 54*a*, respectively. End portions of strips 50, 952, 54 remain integrally attached to the first panel 922 at strip portions 50*b*, 952*b* and 54*b*, respectively. Each strip 50, 952, 54 has a weakened portion defined by a narrowing of the width of the strip at portions 50*c*, 952*c* and 54*c*, respectively, and parallel "U" shaped ends 50*d*, 952*d* and 54*d*.

The side of the sealing panel 926 which faces the inner film layer 912, including tab portions 27, is coated with a releasable adhesive 928 (see FIGS. 19*a* and 19*b*), so that the sealing panel 926 may be resealably secured to the inner film layer 912 at a portion adjacent the inner panel 922, and so that the tab portions 27 remain permanently affixed to the inner film layer 912. The sealing panel 926 includes the tab 930 or other gripping feature which is not coated with adhesive 928, so that the sealing panel 926 may be peeled back from the inner film layer 912 to open the package 910. In addition, structure 940 is not coated with an adhesive, so that a user can easily grasp the structure 940.

Figure 18:
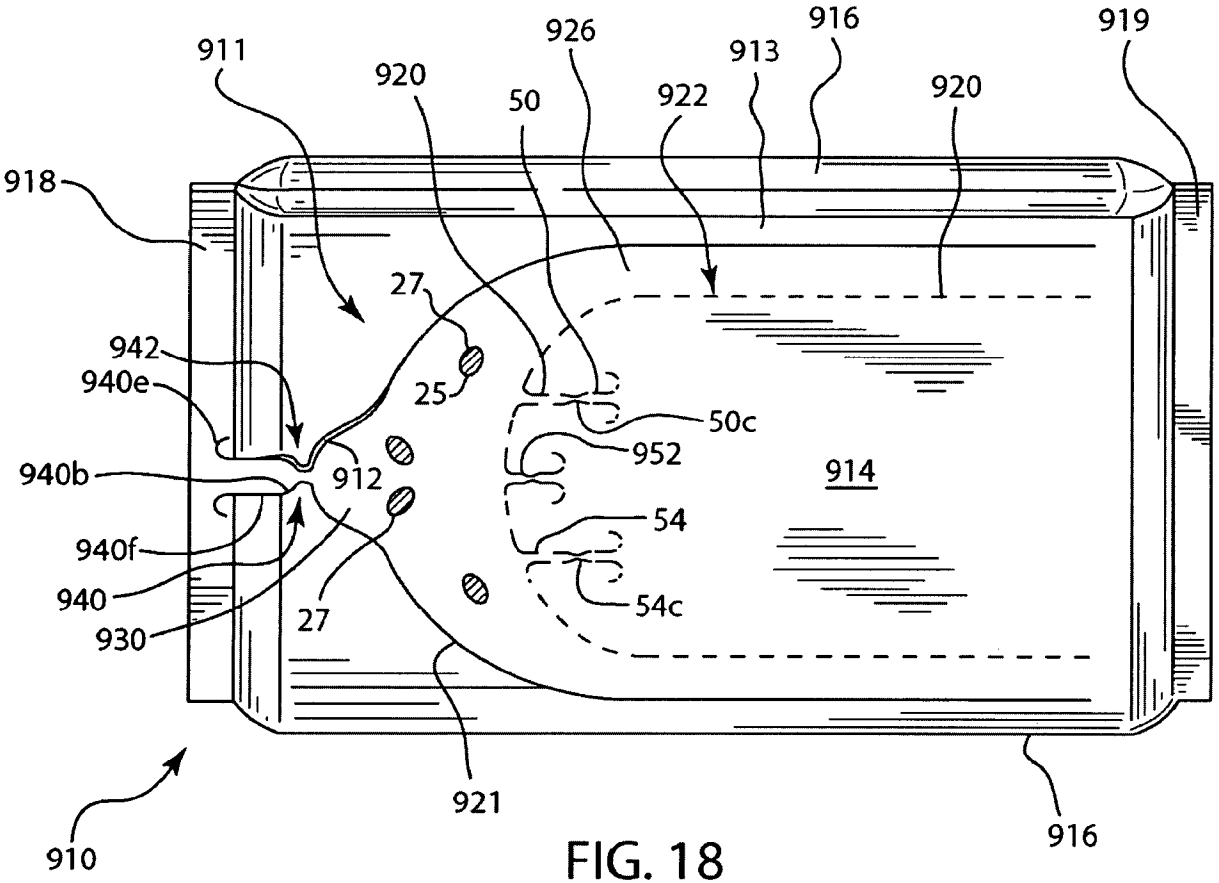
FIG. 18 is a perspective view of another package prior to an initial opening, according to the present invention.
Figure 21A:
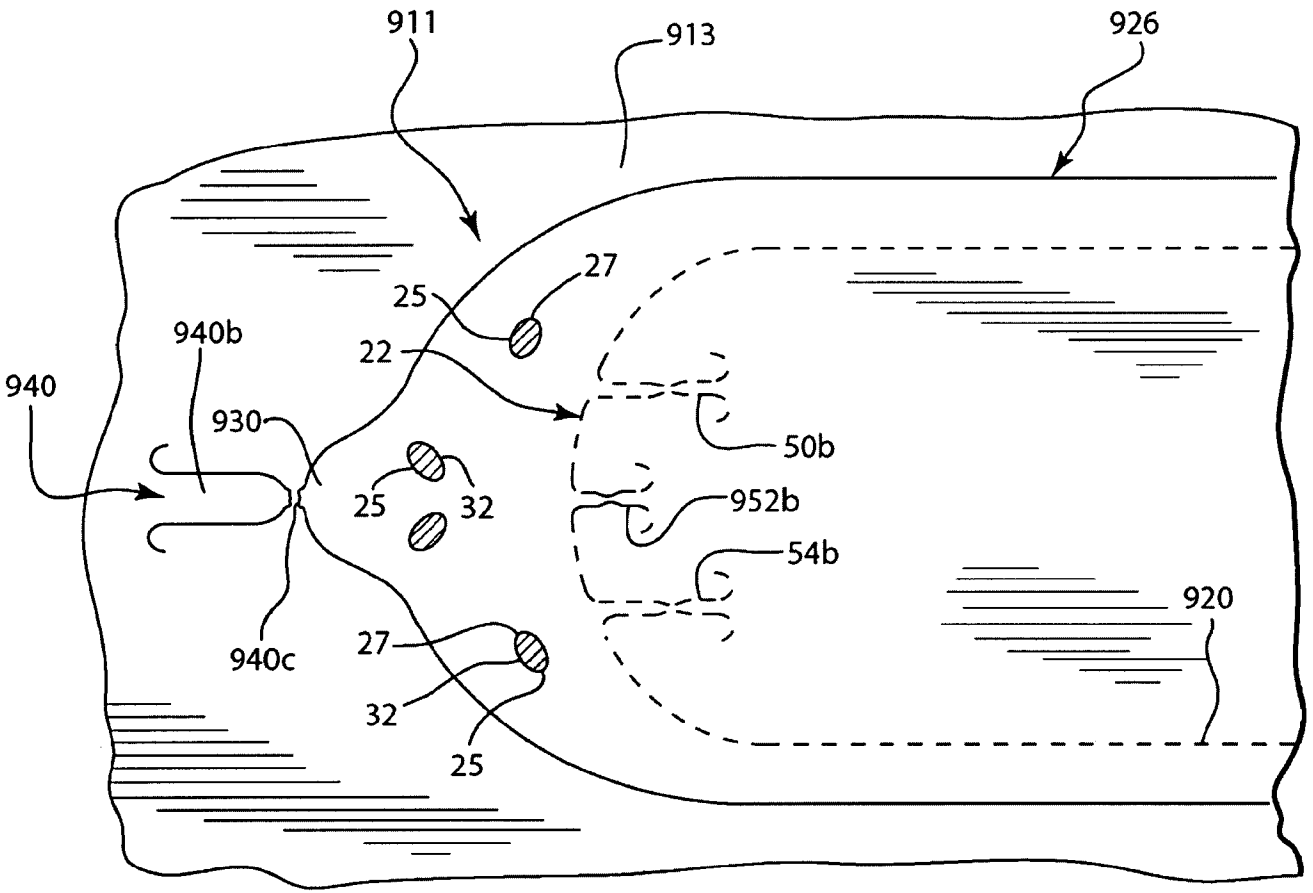
FIG. 21*a* is a partial plan view of the closure of FIG. 18, just after a package integrity feature, in the form of a breakable structure, has been broken.

Referring now to FIGS. 18 and 21*a*, package 10 is preferably opened by first grasping the main portion 940*b* of the package integrity structure 940, which is preferably raised from the top surface of the package 910, with one's fingers and then pulling the main portion 940*b* in a direction parallel to the top surface of the package or slightly up and away from the package to break the structure 940 at the narrow portion of strip 940*c* (see FIG. 4*a*). The polymeric or other flexible material, which comprises outer film layer 913 and thus forms structure 940, allows a user to easily tear the structure 940.

Although it is preferable to first break structure 940 as described above, alternatively, one can break structure 940 by grasping tab 940 and pulling back in a peeling direction 933, which will result in the structure 940 stretching at portion 940*f* until structure 940 eventually breaks, forming ends 940*c*.

Figure 20:
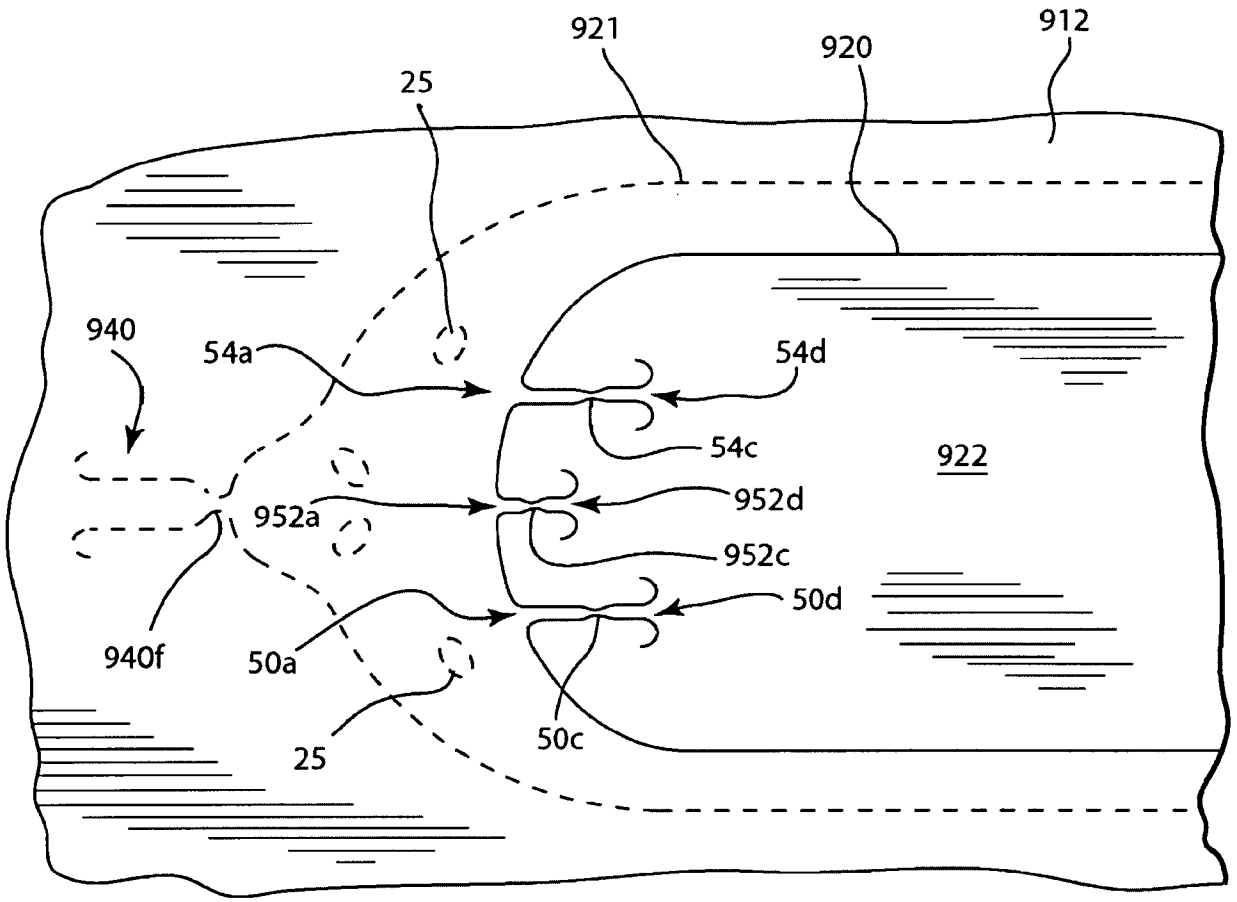
FIG. 20 is a partial plan view of the closure of FIG. 18, as viewed from below, in its initial condition, prior to being opened for a first time.
Figure 21B:
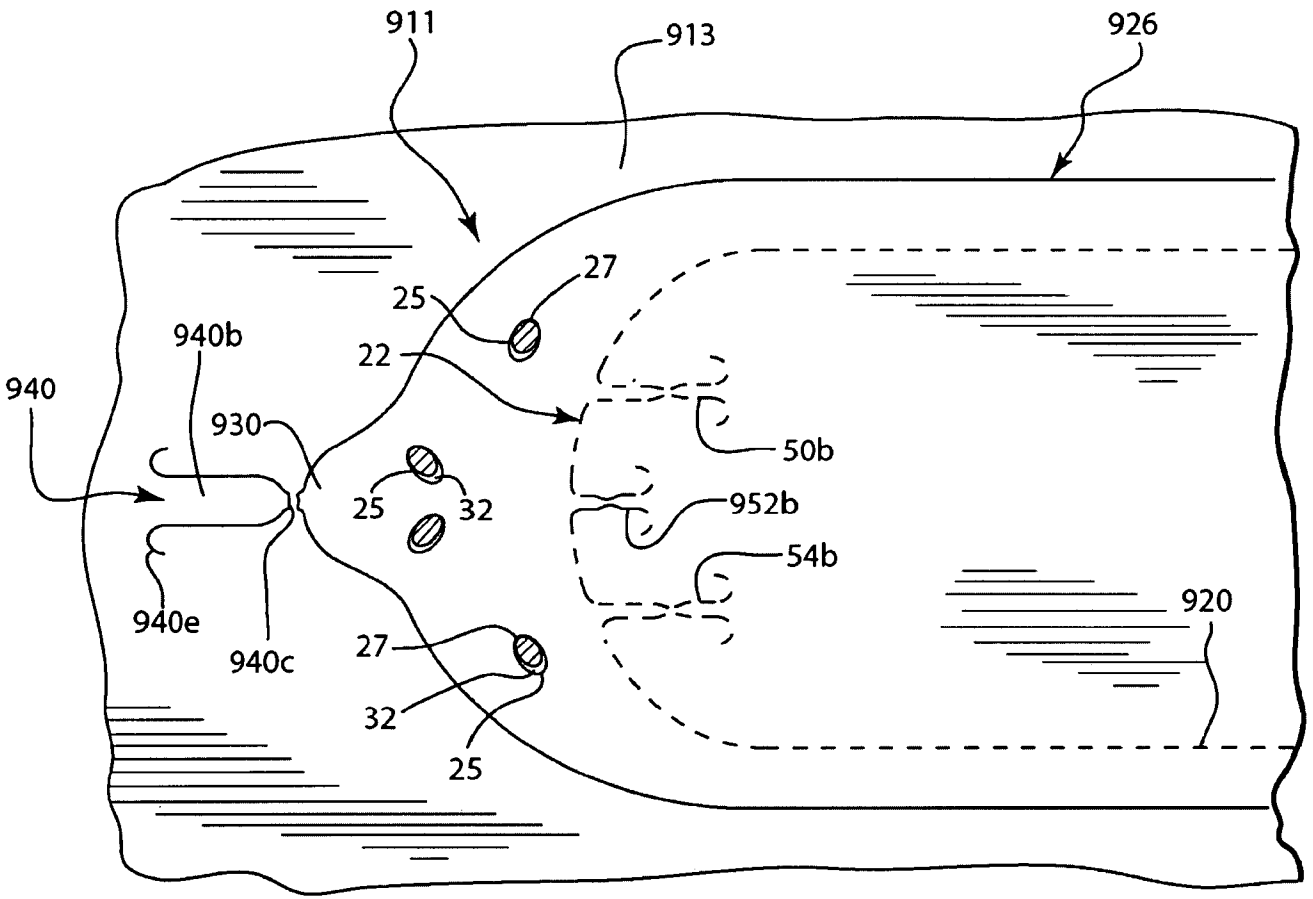
FIG. 21*b* is a partial plan view of the closure of FIG. 18, after an initial opening and resealing.

Referring now to FIGS. 19*a*, 19*b* and 21*b*, after structure 940 has been broken, the sealing panel 926 can be pulled back, resulting in the inner panel 922 being separated from the remainder of the inner film layer 912. Strip portions 50*a*, 952*a*, 54*a* remain integrally attached to the remaining portion of the inner film layer 912 and strip portions 50*b*, 952*b*, 54*b* remain integrally attached to the inner panel 922 (FIG. 20).

In addition, tab portions 27 separate from the sealing panel 26 and remain attached to the inner film layer 12, due to adhesive 28, to thereby form holes 32 in the sealing panel 26 (FIGS. 19 and 21).

Initially, upon opening the closure 911, the strip portions 50*a*, 952*a*, 54*a* separate from the sealing panel 926, while strip portions 50*b*, 952*b*, 54*b* remain attached to the sealing panel 926, as shown in FIG. 19*a*. At some point upon peeling the sealing panel 926 back, strip 952 breaks while strips 50 and 54 remain intact (FIG. 19*a*). Pulling the sealing panel 926 further in the direction of arrow 933 further opens the closure 911 and eventually strips 50 and 54 break at narrowing strip portions 50*c* and 54*c*, respectively.

Package integrity is indicated by closure 911 through several features incorporated into the closure 911. Initially, package integrity is indicated visually by observing an intact package integrity structure 940 which must be broken in order for one to even begin to open the closure 911 by pulling back sealing panel 926. Further, package integrity is indicated by observing intact integrally joined strips 50, 952, 54 which advantageously break upon opening the closure 911 a sufficient amount prior to allowing one to remove the contents therein. In addition, package integrity is indicated by audible sounds produced when the strips break upon opening the package for a first time. Additionally, since the sealing panel 926 does not generally return to its exact original position but, instead, is slightly misaligned relative to its original position, package integrity is indicated by such misalignment of the sealing panel holes 32 with the tab portions 25, as the sealing panel has been opened and resealed (FIG. 21*b*).

Figure 22:
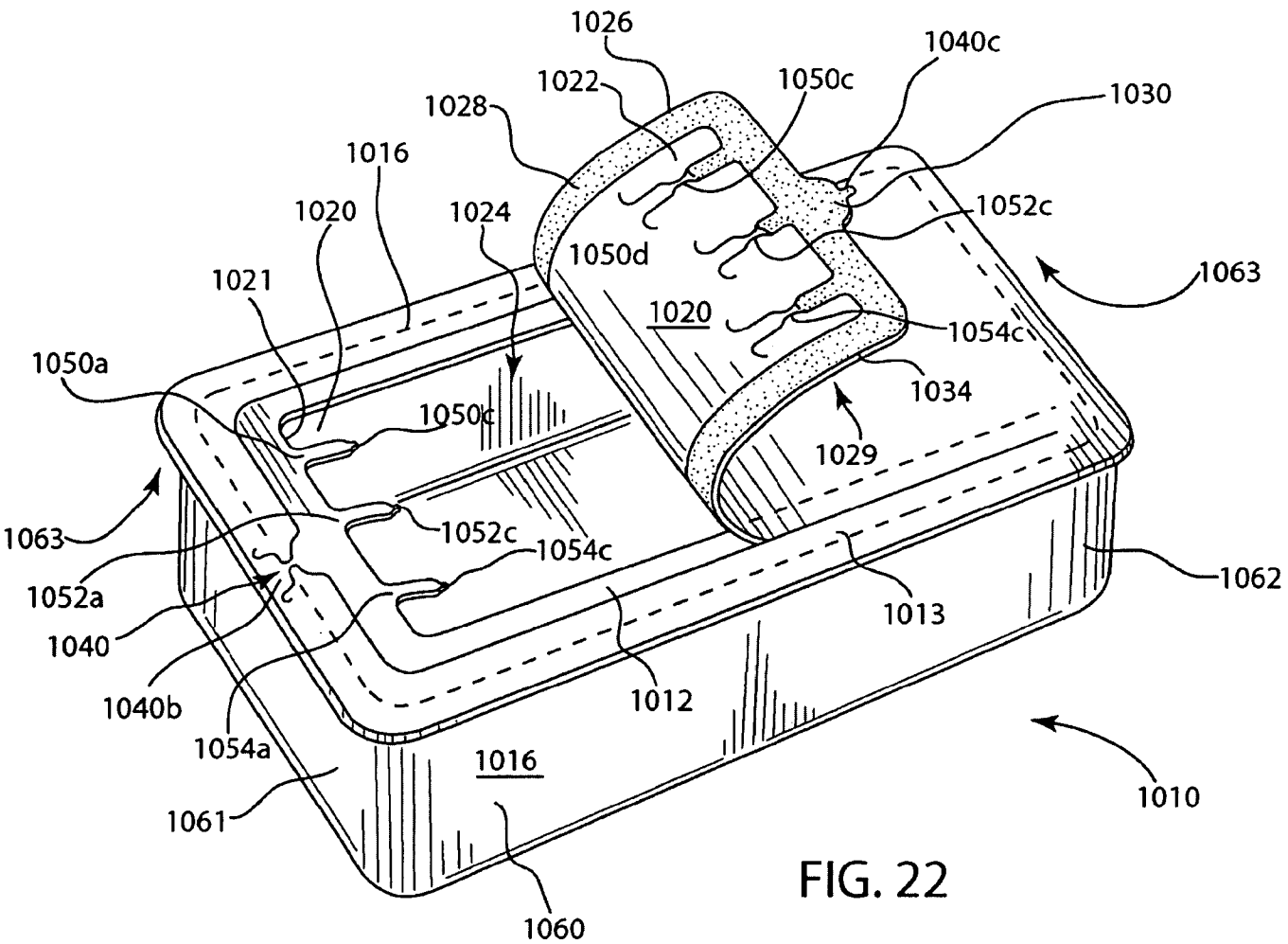
FIG. 22 is a perspective view of another package, in accordance with the present invention, including a closure that has been opened.

Referring now to FIG. 22, like elements to those of the embodiment of FIGS. 1-4 are increased by 1000. Package 1010 comprises a thermoform tray 1060 which forms the sides 1016 and ends 1061, 1062. A two-ply film material comprising an inner film layer 1012 and an outer film layer 1013 is sealed to flange 1063 of the thermoform tray 1060. As with package 10, package integrity is indicated by the presence of an intact structure 1040 being integrally formed with the sealing panel 1026 and a remainder of the outer film layer 1013, which forms the top of the package 1010.

Further, as with package 10, pulling back on table 1030 separates the sealing panel 1026 from the outer film layer 1013 and separates the inner panel 1022 from the inner film layer 1012 and portions of strips 1050, 1052 and 1054. After package 1010 has been opened for a first time, package integrity structure 1040 will be broken and strips 1050, 1052, 1054 will break at narrow strip portions 1050*c*, 1052*c*, 1054*c*, providing visual indication of package integrity status, which shows that the package has previously been opened, as shown in FIG. 22.

Figure 23:
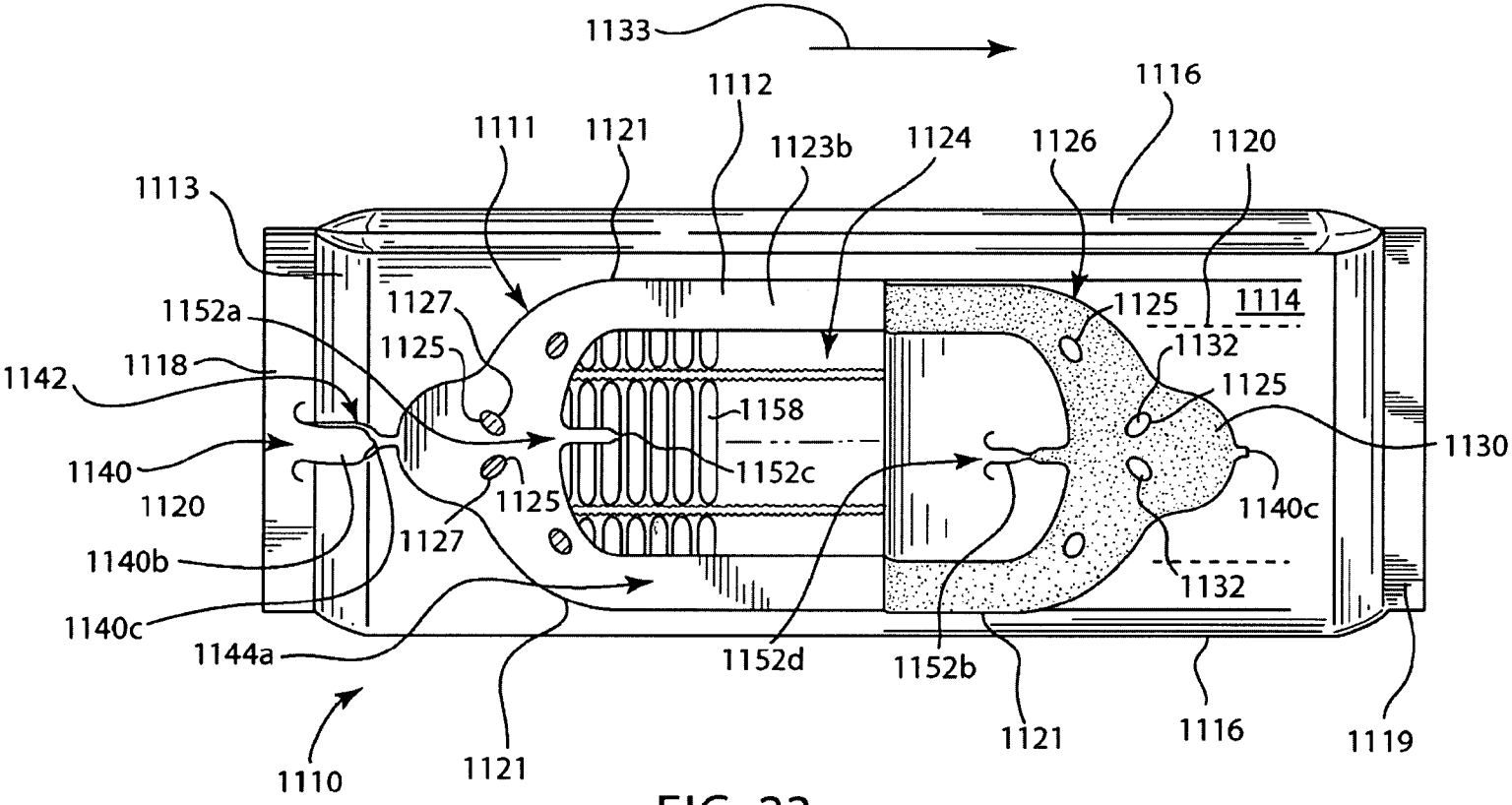
FIG. 23 is a perspective view of another package, in accordance with the present invention, with package integrity feature shown in a partially opened condition.
Figure 24:
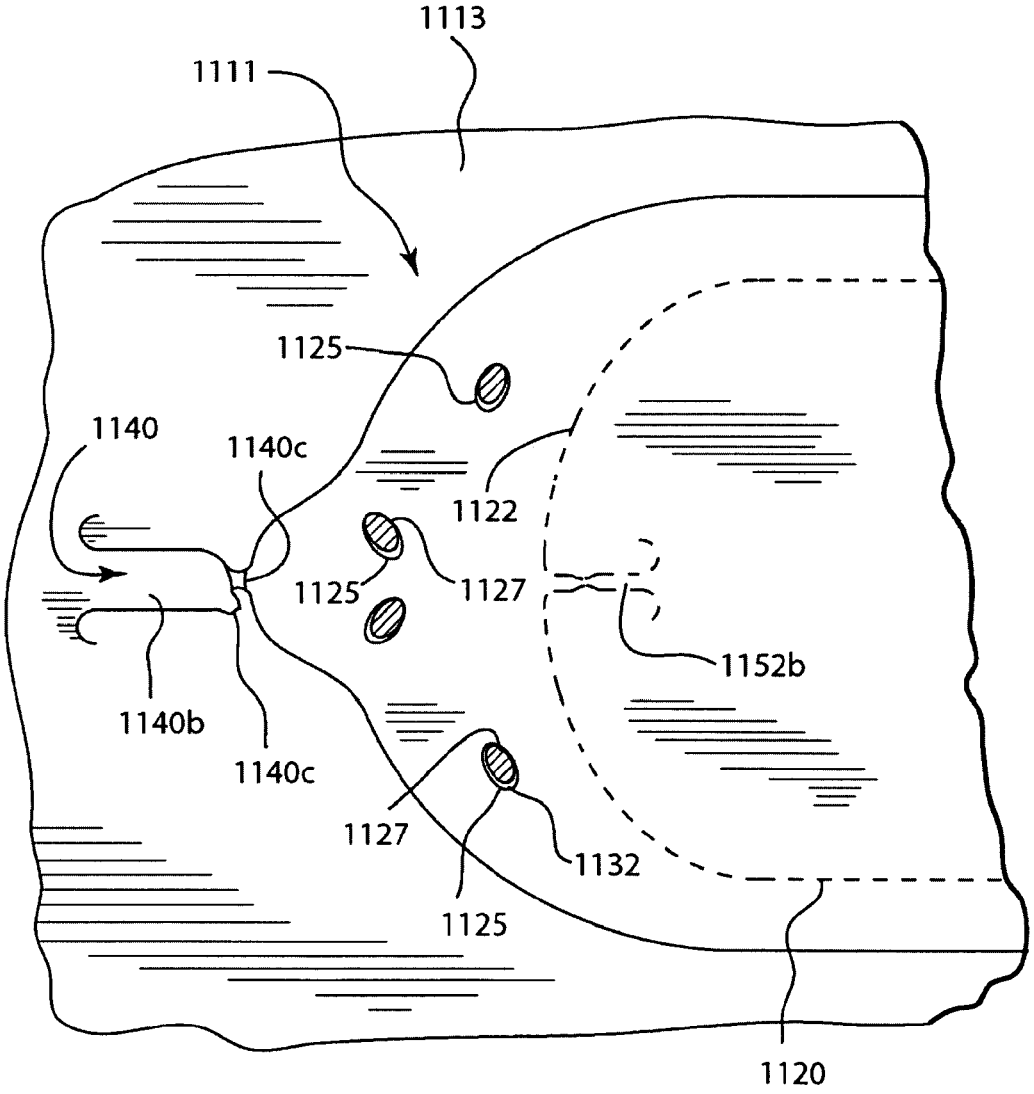
FIG. 24 is a partial plan view of the closure of FIG. 23, after an initial opening and resealing.
Figure 25:
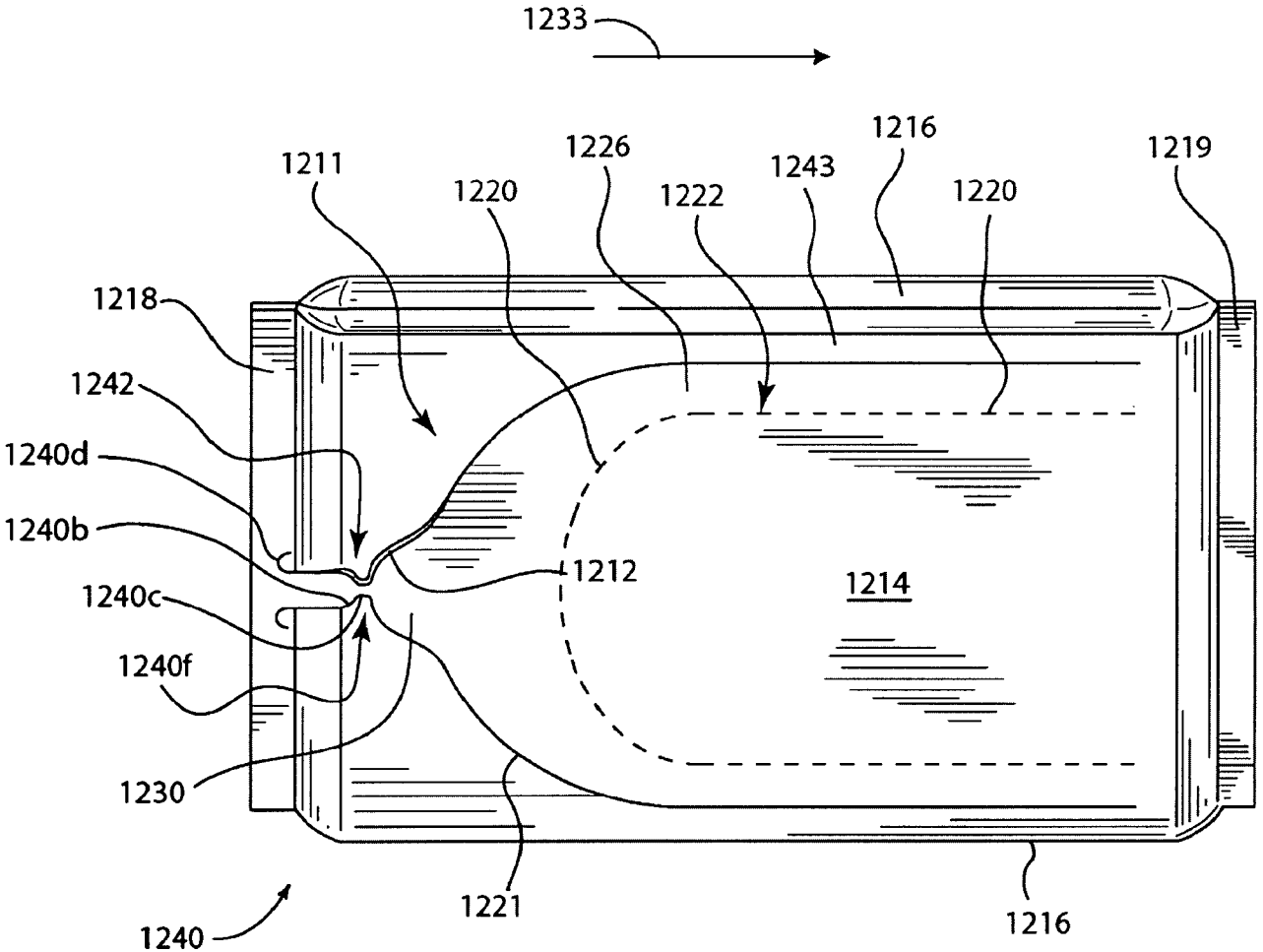
FIG. 25 is a perspective view of another package, prior to an initial opening, in accordance with the present invention.

Referring now to FIGS. 23 and 24, like elements to those of the embodiment of FIGS. 1-4 are increased by 1100. Package 1110 has a single strip 1152 located at a mid-portion of the opening 1124. Package 1110 is designed to accommodate a single row of food items, such as cookies 1158. In order to open package 1110 for a first time, breakable structure 1140 must be broken, separating package integrity structure main body 1140*b* from the tab portion 1130, thereby allowing one to pull back sealing panel 1126 from the top of the package 1110. The breaking of structure 1140 can occur either by first detaching the structure from the remaining portion of the sealing panel 1126 or by pulling back on tab 1130, which will stretch and eventually break structure 1140*c*. Package integrity is indicated by a broken structure 1140, as well as by observing the status of the strips 1152 and the alignment of tab portions 1125 with sealing panel holes 1132 (FIG. 24). As previously noted above, the package integrity feature of the present invention can be used by itself, instead of as a complement to the package integrity features of the '751 application. FIG. 25 is representative of any package, wherein the package integrity feature of the present invention is the sole package integrity feature.

Referring now specifically to FIG. 25, like elements to those of the embodiment of FIGS. 1-4 increases by 1200. Package 1210 includes package integrity feature 1240, joined to tab 1230, as the sole package integrity feature. Package integrity is indicated in package 1210 by an intact structure 1240 attached to tab 1230. Prior to opening package 1210 for a first time, one either grasps the narrow portion of strip 1240*f* and separates it from tab 1230, which subsequently allows a user to now be able to pull back on tab 1230 to withdraw sealing panel 1226 from the top of package 1210, thereby separating the inner panel 1222 from the inner film layer 1212 to gain access to the contents contained within the package 1210. Alternatively, a user may grasp tab 1230 and pull back in a peeling direction 1233, which will result in structure 1240 breaking at portion 1240*c*, thereby allowing one to continue to pull back sealing panel 1226 to gain access to the contents therein.

As will be apparent to one of ordinary skill in the art, the present package integrity feature of the present closure offers benefits over prior tamper-evident or package integrity features.

We claim:

1. A package comprising;

an inner film layer, the inner film layer having an inner cut to define, in part, an access opening through the inner film layer;

an outer film layer adhesively joined to the inner film layer, the outer film layer having an outer cut to define a sealing panel which covers the access opining, the sealing panel including a pull tab; and a tamper structure comprised of a strip of film defined by the outer cut and, prior to initial opening, the tamper structure attaching the pull tab to an adjacent portion of the outer film layer;

wherein the tamper structure stretches and eventually breaks upon initial package opening thereby creating an audible snapping sound indicating that the package is being initially open and the outer cut forming the tamper evident structure has a tear-inhibiting, parallel u-shaped configuration at the end thereof that prevent propagation of the outer cut.

2. The package of claim 1, wherein the tamper structure breaks upon grasping the pull tab to pull back the sealing panel to gain access to the package for the first time.

3. The package of claim 1, wherein the tamper structure breaks upon grasping a narrow weakened portion of the structure to gain access to the package for the first time.

4. The package of claim 1, wherein the tamper structure includes two wider ends with a narrower portion in between the two wider ends and the outer cut at a portion of the tamper structure adjacent a remainder of the outer film includes tear-limiting ends.

5. The package of claim 1, wherein the tamper structure and the pull tab are raised from an upper surface of the package, defining a gap between the tamper structure, the pull tab, and the inner film layer so the pull tab and the tamper structure are graspable from below.

6. The package of claim 1, wherein the inner film layer includes at least one strip attached to the sealing panel, such that the strip breaks upon pulling back the sealing panel to gain access to the package for the first time.

7. The package of claim 1, wherein the outer film layer includes an even number of strips attached to the sealing panel on either side of the pull tab, such that the strips break upon pulling back the sealing panel to gain access to the package for the first time.

8. A package integrity feature comprising:

a structure associated with an end portion of a resealable closure of a container, the structure comprising a film strip and breakably attached to the end portion on one end and permanently attached to a remainder of the container, wherein the breakable structure is constructed such that it can be stretched and grasped from below with one's fingers and broken to thereby break its connection between the end portion and the remainder of the container, thereby leaving the end portion free of its attachment to the container through the structure and thereby creating an audible snapping sound indicating that the package is being initially open, wherein the breakable structure is formed by cuts having a pair of tear-inhibiting portions wherein the tear-inhibiting portions extend away from each other near the ends thereof and prevent the propagation of the outer cut.

9. The package integrity feature of claim 8, wherein the structure is a strip extending between the end portion of the closure and an adjacent portion of the container.

10. The package integrity feature of claim 9, wherein the strip includes a weakened portion.

11. The package integrity feature of claim 10, wherein the weakened portion is in the form of a narrowing of a portion of the strip.

12. The package integrity feature of claim 8, wherein the structure is raised from a top surface of the container.

13. The package integrity feature of claim 9, wherein the structure is integrally formed from a material which comprises a surface surrounding the closure.

14. The package integrity feature of claim 9, further comprising a container with a top which incorporates the resealable closure, the resealable closure comprising a sealing panel which covers an access opening into the container and sealingly engages the top around the access opening so as to originally seal the closure and then, after having been opened a first time, reseals against the top, the structure associated with the sealing panel and the top, the structure breakably attached to the sealing panel on one end and permanently attached to a remainder of the top at another end.

15. The package of claim 8, wherein the structure is a strip extending between a tab portion of the sealing panel which is not adhesively sealed to the top and the remainder of the top.

16. The package of claim 8, wherein the end portion comprises a tab portion of the resealable closure.

17. A package integrity indicating closure, the closure comprising:

a film layer forming a top of a container, the film layer having a flap defining an access opening to gain access to the contents of the container;

a sealing panel completely covering the flap of the film layer, the sealing panel comprising a pull tab with an elongate film strip extending therefrom which is permanently affixed to the top, the pull tab and the film strip defining a gap between the top surface of the container and the pull tab and film strip and the pull tab being formed, in part, by cuts in the film layer, wherein the cuts define the film strip and have tear-inhibiting, u-shaped configurations on an end thereof such that the film strip is configured to stretch and break between the tear-inhibiting, u-shaped configurations that prevent propagation of the cuts and the pull tab when the sealing panel is opened; and releasable adhesive provided on either or both the sealing panel or the film layer for adhering the sealing panel to the film layer, wherein the sealing panel is releasable from the film layer after the film strip joining the sealing panel to a portion of the top has been stretched and broken by pulling the sealing panel back in a peeling direction thereby creating an audible snapping sound indicating that the package is being initially open and is reclosable against the top to seal the access opening when the sealing panel is moved back against the top.

18. The package integrity indicating closure of claim 17, wherein the strip comprises a weakened portion.

19. The package integrity indicating closure of claim 17, wherein the sealing panel and the strip are integrally formed with each other.

20. The package integrity indicating closure of claim 17, wherein the sealing panel and the strip are die cut from a material which forms the top surface of the container and which is disposed on the film layer.

* * * * *